US005877477A

United States Patent [19]

Petty et al.

[11] Patent Number: 5,877,477

[45] Date of Patent: Mar. 2, 1999

[54] OVEN WITH HIGH POWER RADIANT COOKING ELEMENTS AND METHODS OF DEVELOPING, OPTIMIZING, STORING, AND RETRIEVING RECIPES FOR THE OPERATION OF THE OVEN

[75] Inventors: J. Scott Petty; Edward R. Cook, both of Cedar Rapids, Iowa

[73] Assignee: Amana Company, L.P., Amana, Iowa

[21] Appl. No.: 769,616

[22] Filed: Dec. 18, 1996

[51] Int. Cl.[6] ..... H05B 1/02

[52] U.S. Cl. ..... 219/506; 219/492; 219/483; 219/486; 219/413; 219/711; 219/719; 99/328; 99/335; 99/325

[58] Field of Search ..... 219/483–486, 219/508, 509, 497, 492, 506, 411, 711, 720, 719, 412, 413; 99/325, 333, 443 C, 326, 331, 328, 335

[56] References Cited

U.S. PATENT DOCUMENTS

| | | | |
|---|---|---|---|
| 4,396,817 | 8/1983 | Eck | 219/10.55 M |
| 4,517,429 | 5/1985 | Horinouchi | 219/10.55 B |
| 4,914,277 | 4/1990 | Guerin et al. | 219/506 |
| 5,036,179 | 7/1991 | Westerberg et al. | 219/405 |
| 5,253,564 | 10/1993 | Rosenbrock et al. | 99/328 |
| 5,352,874 | 10/1994 | Gong | 219/704 |
| 5,620,624 | 4/1997 | Westerberg | 219/411 |

FOREIGN PATENT DOCUMENTS 0 066 637 12/1982 European Pat. Off. .

OTHER PUBLICATIONS

European Search Report, dated Mar. 10, 1998, Application No. EP 97 12 2325.

*Primary Examiner*—Mark H. Paschall
*Attorney, Agent, or Firm*—Tobor & Goldstein, L.L.P.

[57] ABSTRACT

An oven with high power radiant cooking elements which are capable of operating at different intensities is disclosed for cooking food quickly with infrared radiation. The conduction of this infrared radiant energy varies substantially from food to food. Accordingly, the user of the oven must develop a unique data base or recipe for each food. A recipe consists of a number of stages each of which defines the output intensity of each cooking element for a period of time. A method is disclosed for the real time development of a recipe by varying the intensity of the cooking elements during the cooking cycle, optimizing the developed recipe to reduce the number of stages, storing the optimized recipe in memory and retrieving the optimized stored recipe for future use.

12 Claims, 13 Drawing Sheets

AMANA WAVE OVEN
MENU:A *READY*

Fig. 5a

C:100% O:100% B:100%
0:00 *READY*

Fig. 5b

C: 60% O:100% B:100%
0:00 *READY*

Fig. 5c

C: 60% O:70% B:50%
2:33 *READY*

Fig. 5d

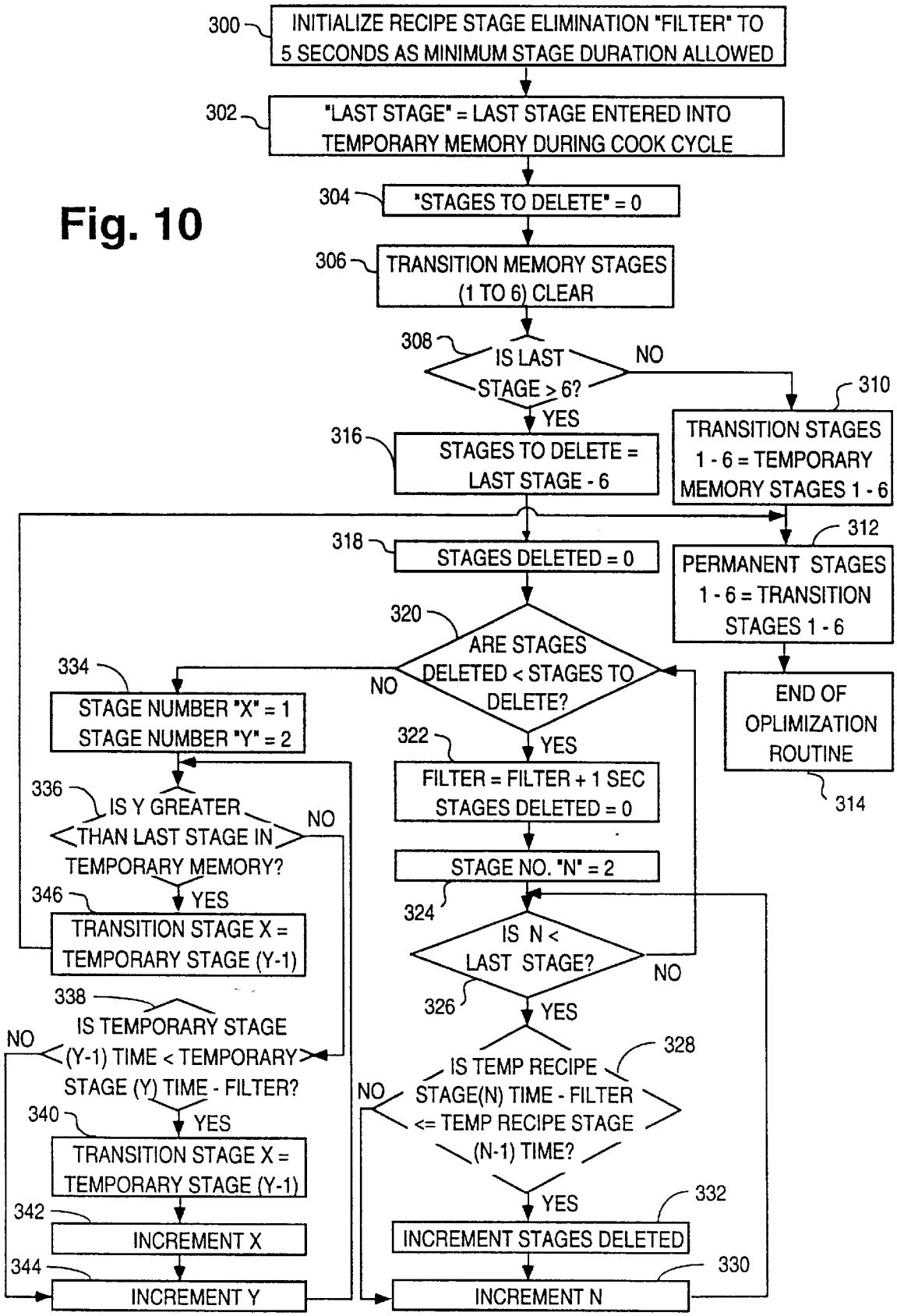
Fig. 10
300
INITIALIZE RECIPE STAGE ELIMINATION "FILTER" TO 5 SECONDS AS MINIMUM STAGE DURATION ALLOWED
302
"LAST STAGE" = LAST STAGE ENTERED INTO TEMPORARY MEMORY DURING COOK CYCLE
304
"STAGES TO DELETE" = 0
306
TRANSITION MEMORY STAGES (1 TO 6) CLEAR
308
IS LAST STAGE > 6?
NO
YES
310
TRANSITION STAGES 1 - 6 = TEMPORARY MEMORY STAGES 1 - 6
316
STAGES TO DELETE = LAST STAGE - 6
312
PERMANENT STAGES 1 - 6 = TRANSITION STAGES 1 - 6
318
STAGES DELETED = 0
320
ARE STAGES DELETED < STAGES TO DELETE?
NO
YES
END OF OPLIMIZATION ROUTINE
314
334
STAGE NUMBER "X" = 1
STAGE NUMBER "Y" = 2
322
FILTER = FILTER + 1 SEC
STAGES DELETED = 0
STAGE NO. "N" = 2
336
IS Y GREATER THAN LAST STAGE IN TEMPORARY MEMORY?
NO
YES
346
TRANSITION STAGE X = TEMPORARY STAGE (Y-1)
324
IS N < LAST STAGE?
NO
YES
326
338
IS TEMPORARY STAGE (Y-1) TIME < TEMPORARY STAGE (Y) TIME - FILTER?
NO
YES
328
IS TEMP RECIPE STAGE(N) TIME - FILTER <= TEMP RECIPE STAGE (N-1) TIME?
NO
YES
340
TRANSITION STAGE X = TEMPORARY STAGE (Y-1)
342
INCREMENT X
344
INCREMENT Y
332
INCREMENT STAGES DELETED
330
INCREMENT N

OVEN WITH HIGH POWER RADIANT COOKING ELEMENTS AND METHODS OF DEVELOPING, OPTIMIZING, STORING, AND RETRIEVING RECIPES FOR THE OPERATION OF THE OVEN

FIELD OF THE INVENTION

The present invention relates to ovens having at least two high power infrared radiant elements which are capable of operating at variable intensities or output power levels to cook food. Furthermore, the present invention relates to methods for developing a data base or recipe that defines the intensity or output power level of each element for specific time periods required to cook a particular food item in such ovens, storing the developed recipe in memory and recalling the recipe to control the operation of the oven when the same food item is being cooked in the future to assure that the food item is prepared in a consistent manner. In particular, the present invention relates to methods of creating in real time a data base or recipe which specifies the intensity or output power level of each high power radiant element for specific time periods or stages, optimizing the data base to a predetermined number of stages, storing the optimized data base in memory and retrieving the optimized data base for the subsequent control of the oven.

BACKGROUND OF THE INVENTION

Ovens using high power radiant elements such as halogen tungsten lamps cook food quickly with infrared radiation. When cooking with infrared radiant elements the energy impinging upon the food surface is conducted into the interior of the food. The conduction of this infrared radiant energy varies substantially from food to food. Due to the high intensity of the infrared radiant elements used in these ovens many foods require that the output power level or intensity of the elements be changed during the cooking process to assure that the food item is properly cooked. The change in the output power level of the elements allows the food time to conduct the infrared radiant energy into the interior of the food without burning the food surface. Accordingly, the user of the oven is required to develop a unique data base or recipe for each food. A recipe consists of a number of stages or segments each of which defines the output power level or intensity of each of the infrared radiant elements for a period of time. Known ovens using infrared radiant cooking elements limit the recipe to two stages. For example, an oven with three infrared radiant elements A, B and C might have the following recipe for a specific food: A at 100% intensity, B at 70% intensity and C at 100% intensity for 30 seconds; and, A at 50% intensity, B at 50% intensity and C at 20% intensity for 60 seconds.

By limiting the number of stages the creativity in recipe development is restricted. Furthermore, by limiting the number of stages even the variety of foods which can be cooked is reduced. In these known ovens the user is required to enter the intensity level of each radiant element and the cooking time manually into a control or memory before the cooking process begins. During the cooking cycle the output power levels or intensity of the infrared radiant elements and the time periods are controlled in accord with the recipe as is well known to one of ordinary skill in the field. After the cooking is complete the user must analyze the food's quality. If the food is not satisfactorily cooked, the user must adjust the recipe by changing the intensity level of at least one element or the length of the time periods or stages or both and then cook the identical food again. This trial and error method of recipe development must be repeated until the food item is properly cooked. Once the recipe or data base is finalized it is stored in memory for future use in cooking the same food item. This trial and error method of recipe development is time consuming and frustrating to the user.

Accordingly, there is a need for an oven having high power infrared radiant elements which uses a method for the real time development of recipes having at least two stages. In addition, there is a need for such an oven which allows the user to develop a multiple stage recipe in real time by varying the intensity of the cooking elements during the cooking processes and to store the recipe in memory thereby avoiding the trial and error methodology of developing a recipe while providing the user flexibility in recipe development.

SUMMARY OF THE INVENTION

The present invention is an oven using high power radiant elements such as halogen tungsten lamps which are capable of operating at variable intensities or output power levels to cook food and methods for developing a recipe or data base for a particular food by changing the output power level or intensity of the elements for specific time periods or stages while cooking a particular food, optimizing the data base to comprise no more than a predetermined number of stages and storing in memory the optimized database for future use. The output power level or intensity for each of the high power radiant elements is set to zero and the run time is set to zero. This information is stored in a temporary or random access memory (RAM). This data forms the first stage of the recipe. The user also sets the overall cook time and stores this data in the temporary memory. The method of recipe development is based upon the premise that the user's eye provides the best feedback during the cooking process to enable the user to change the output power levels or intensity of the elements. The user determines what output power intensity or level each of the different elements should be set at while cooking from visual feedback. After some period of time the user changes the intensity level of one of the elements from, for example, 100% to 50%, now the intensity level of all of the elements and the run time at which the change was made are entered into RAM memory as the second stage of the recipe. The user can repeat the change sequence as described any number of times with each change causing the intensity level of all of the elements and the run time at which the change was made to be stored in temporary memory as another stage. After the original cook time expires or power is turned off to the radiant elements the intensity level of each element is set to zero and the run time is stored in temporary memory as the final stage. The user has the choice of extending the original cook time so that the recipe can be developed further. If the original cook time is extended the above process is repeated. If the original cook time is not extended the recipe is final and the various stages stored in temporary memory are optimized so that the total number of stages does not exceed a fixed number. Once the recipe is optimized it is stored in permanent or read only memory (ROM) for future use when cooking the same food.

BRIEF DESCRIPTION OF THE DRAWINGS

The advantages of the invention will become apparent upon reading the following detailed description and upon reference to the accompanying drawings, in which:

FIGS. 5*a*–5*d* are front views of the display screen of the oven showing different messages;

FIG. 10 is a flow diagram of the optimization process according to the present invention;

Figure 1:
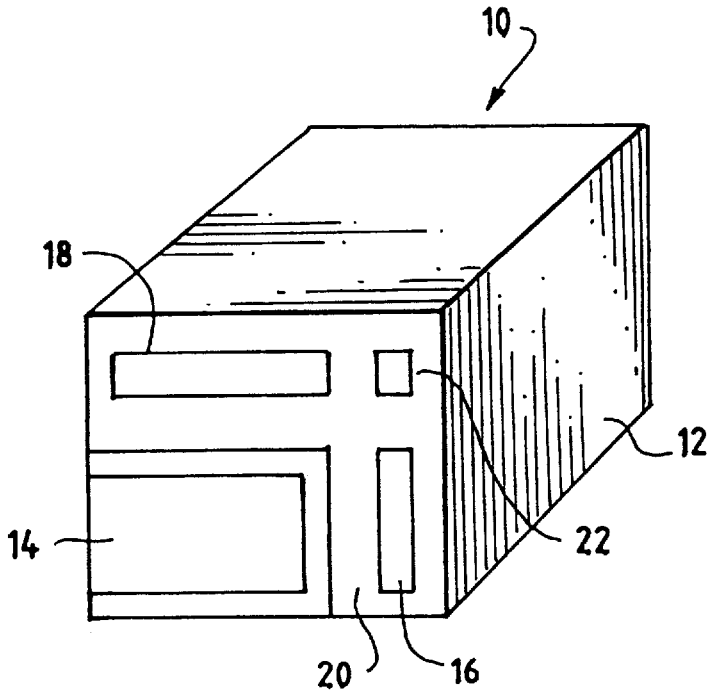
FIG. 1 is a perspective view of an oven using high radiant infrared energy to cook food.

While the invention is susceptible to various modifications and alternative forms, specific embodiments thereof have been shown by way of example in the drawings and will herein be described in detail. It should be understood, however, that the invention is not intended to be limited to the particular forms disclosed. On the contrary, the Applicant's intention is to cover all modifications, equivalents, and alternatives falling within the spirit and scope of the invention as defined by the appended claims.

DETAILED DESCRIPTION OF THE INVENTION

FIG. 1 illustrates a oven 10 that uses high power radiant cooking elements to cook food. The oven 10 has a housing 12 as is well known in the field. A windowed door 14 is capable of opening so that the user can place the food to be cooked within the oven cavity and view the cooking process through the window. A control panel 18 is mounted on the front wall 16 of the oven 10. The control panel 16 contains a plurality of buttons or switches and is more clearly illustrated in FIG. 3. A bank of numerically designated switches 20 is also mounted on the front wall 16 of the oven 10 and is more clearly illustrated in FIG. 4. The control panel 18 and the bank of switches 20 form the keypad that the user operates to convey information to the oven 10 or to initiate functions performed by the oven 10. A display screen 22 is mounted on the front wall 16 of the oven 10 to illustrate various messages or convey information to the user and is more clearly illustrated in FIGS. 5*a*–5*d*. The position of the control panel 18, the bank of switches 20 and the display screen 22 are matters of design choice.

Figure 2:
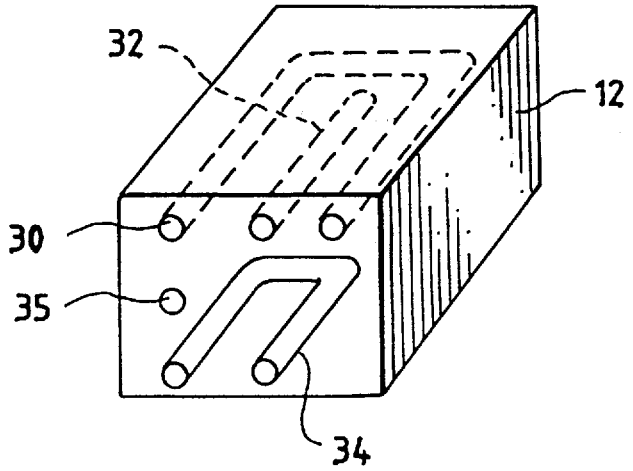
FIG. 2 is a cross section of the oven taken along line 1—1 of FIG. 1 showing the location of three high power radiant energy cooking elements.

FIG. 2 is a cross section of the oven 10 taken along line 1—1 to illustrate the position of the high power infrared radiant cooking elements. At least two such cooking elements are necessary to properly cook food in oven 10, however, any number of cooking elements above two can be used. In the preferred embodiment, three cooking elements are illustrated. The shape and position of the cooking elements is a matter of design choice. A first high power infrared radiant cooking element 30 such as a halogen tungsten lamp having a generally U-shape is placed towards the top of the oven 10. Cooking element 30 extends along both sides and the back of the oven 10. A second high power infrared radiant cooking element 32 having a generally linear shape is placed towards the top of the oven 10. Cooking element 32 extends from near the front wall 16 to the back of the oven 10 and is centrally located generally an equal distance from each side wall of oven 10. Finally, a third high power infrared radiant cooking element 34 having a generally U-shape is placed toward the bottom of the oven 10. Cooking element 34 extends along both sides and the back of the oven 10. As is well known, the food item to be cooked is placed on a shelf or rack (not illustrated for the sake of clarity) so that the top of the food item is exposed to infrared radiant energy from the top outside cooking element or the first cooking element 30 and the top center cooking element or the second cooking element 32 and the bottom of the food item is exposed to infrared radiant energy from the bottom cooking element or third cooking element 34. A temperature probe 35 is positioned along one of the side walls of the oven 10. The type of temperature probe and its location are matters of design choice. The temperature probe is used to determine the temperature of the oven cavity before a cooking cycle begins for the automatic temperature compensation process which is described herein and which is the subject of a co-pending application entitled "Oven With High Power Radiant Cooking Elements and Stored Recipes and a Method for Automatically Compensating for the Current Oven Cavity Temperature", filed on the same date and assigned to the same assignee as the present application.

Figure 3:
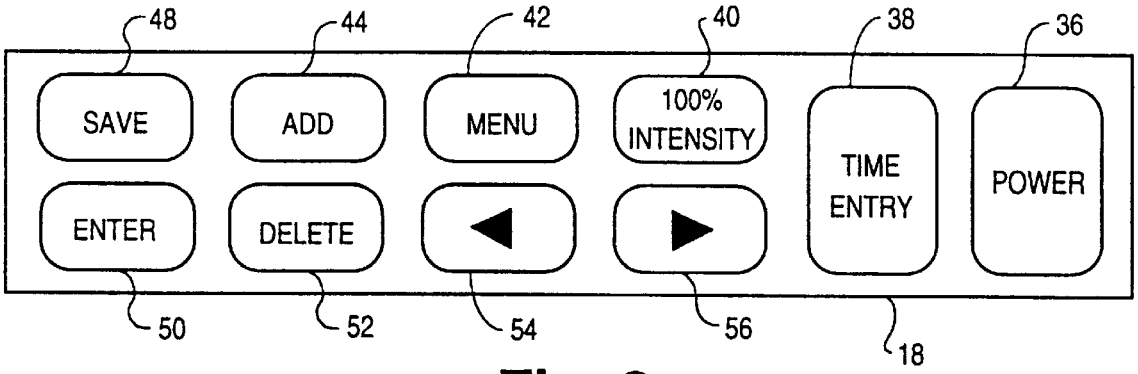
FIG. 3 is a front view of the control panel of the oven.
Figure 4:
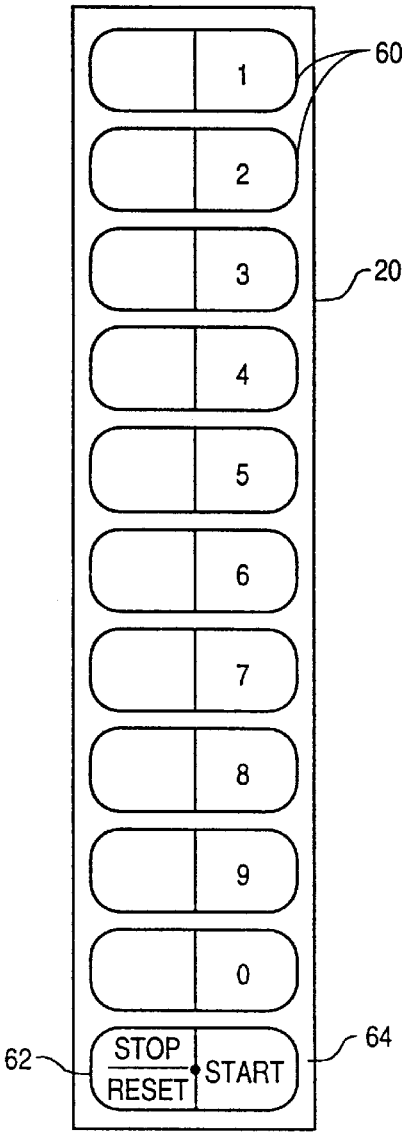
FIG. 4 is a front view of the switch bank of the oven.

FIG. 3 illustrates the control panel 18 shown generally in FIG. 1. The control panel comprises a power on key or switch 36, a time entry key 38, a 100% intensity key 40, menu key 42, add key 44 which adds an additional 20 seconds to the overall cooking cycle, save key 48, enter key 50, delete key 52, left arrow key 54 and right arrow key 56. FIG. 4 illustrates the bank of switches 20 shown generally in FIG. 1. The bank of switches 20 comprises a plurality of numeric keys 60 ranging from 0 through 9, stop/reset key 62 and start key 64. The layout or position of the various keys of the control panel 18 and the bank of switches 20 is a matter of design choice. In addition the type of switch or key is also a matter of design choice and is well within the ability of someone skilled in the art. The function performed in response to a particular key being activated is described in the flow charts of FIGS. 7 through 11.

FIGS. 5*a* through 5*d* are illustrations of the display screen 22 shown generally in FIG. 1. The various messages and information appearing on the display screen is described in the flow charts of FIGS. 7 through 11. FIGS. 5*a*–5*d* show a sample of the various messages displayed on the screen 22, for the sake of clarity other message are described in the specification but not illustrated in the drawing since the specific text of any message is a matter of design choice. Any type of display screen can be used as is well known to one skilled in the field.

The infrared radiant cooking elements 30, 32 and 34 generate energy that impinges upon the food surface and is then conducted into the interior of the food for proper cooking. However, the conduction of the infrared radiant energy varies from food to food and many foods require the output power or intensity level of the cooking elements to vary during the cooking process in order to assure that the food is properly cooked throughout without burning the surface of the food. Accordingly, the user of the oven 10 must develop a recipe or data base, for each food item to be cooked. The recipe or data base consists of a number of stages or segments each of which defines the output power level or intensity of each infrared radiant element for a period of time. The user of the oven 10 develops the recipe by initially selecting and storing in temporary memory the output power level or intensity of each cooking element with the run time equal to zero. This data forms the first stage of the recipe. At this time the user also stores in temporary memory the overall cooking time. The user presses the start button to initiate the cooking cycle and views the food as it is being cooked and, as needed, changes the power output level or intensity level of the cooking elements. During the cooking cycle each time the intensity of a cooking element is changed a new stage in the recipe is formed and the intensity of each cooking element and the run time at which the change was made are stored in the temporary memory. When the total original cooking time expires or the power to the radiant element is shut off the user is given the opportunity to continue with the original cook time or increase the overall cooking time. If the user continues with the original cook time or increases the overall cooking time the above process of creating stages by changing the intensity of the cooking elements and storing data in temporary memory is repeated. If the user does not continue with the original cook time or increase the overall cooking time but rather chooses to save the recipe, then the final stage is completed and the intensity of each cooking element is set to zero and the run time are stored in temporary memory. Now, the developed recipe is optimized by compressing together consecutive stages if the run time of a stage is below a predetermined limit as is more fully explained by reference to the optimization process set forth in FIGS. 10*a* and *b*. The optimized recipe is then stored in permanent memory and can be retrieved for controlling the oven 10 when the same food item is to be cooked in the future. The present invention allows the user extensive flexibility to develop a recipe by changing the output power level or intensity of the cooking elements during the actual cooking process based upon the user's visual observation of the food. In the preferred embodiment, even a recipe recalled from permanent memory can be modified by the user during the subsequent cooking process and the modified recipe stored in memory.

Figure 6:
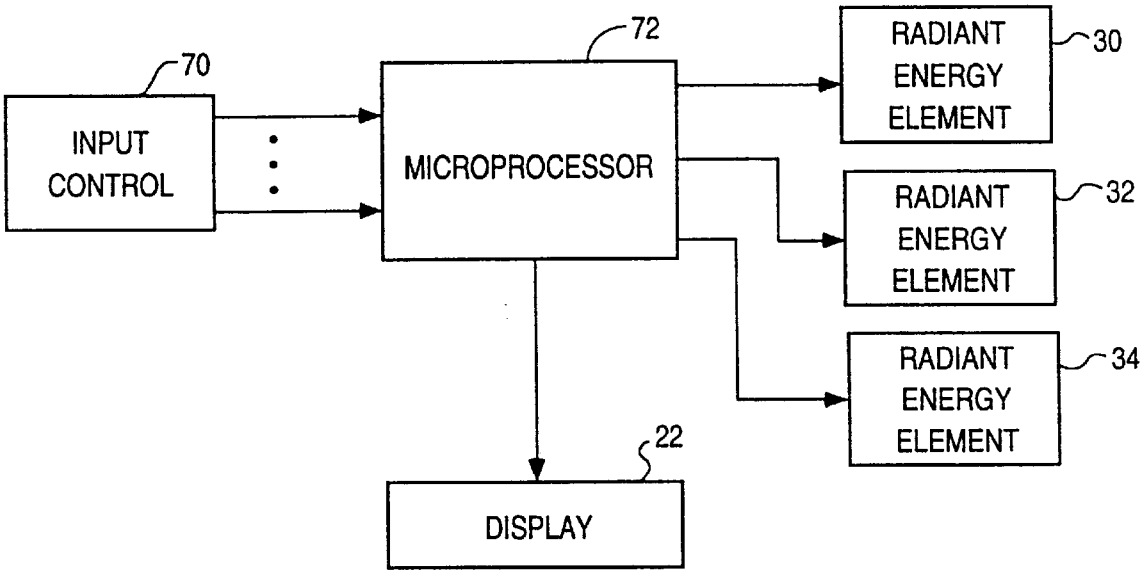
FIG. 6 is a block diagram of a control system for an oven using radiant energy elements according to the present invention.

As shown in FIG. 6, the user of the oven 10 supplies information or operating instructions from an input control or keypad 70 comprising the control panel 18 and the bank of switches 20 to a microprocessor 72. Various calculations and functions are implemented by the microprocessor 72 which also provides an output to the display 22 and to the radiant energy elements 30, 32 and 34. The calculations and functions performed by the microprocessor 72 are described in detail with reference to the flow charts of FIGS. 7 through 11. Any microprocessor capable of performing the various calculations and implementing the various instructions can be used, in the preferred embodiment Hatchi microprocessor H8/338 is used.

Figure 7A:
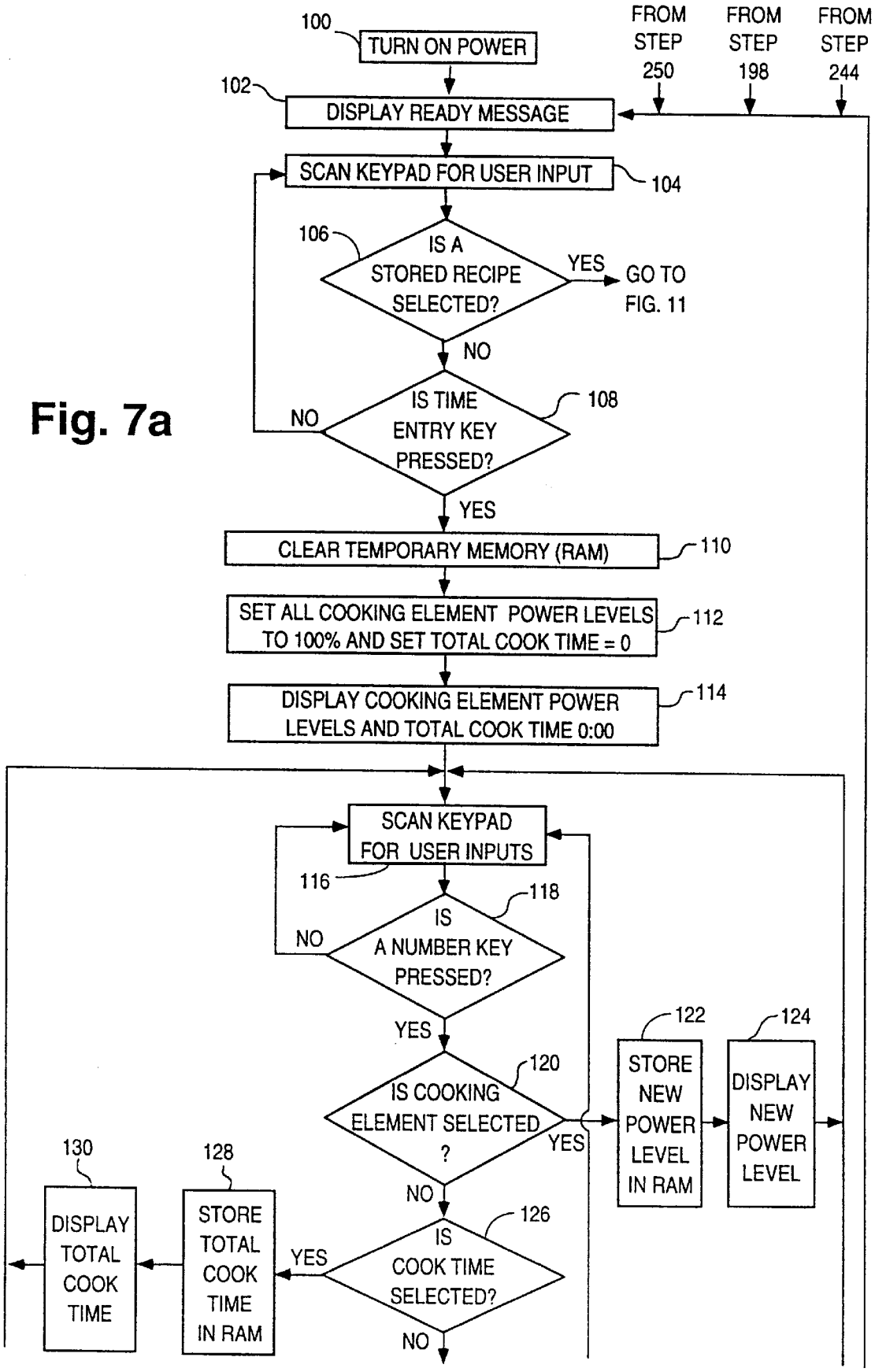
FIGS. 7*a* and *b* are flow diagrams of the initialization of the power levels of the radiant cooking elements and timing according to the present invention.
Figure 7B:
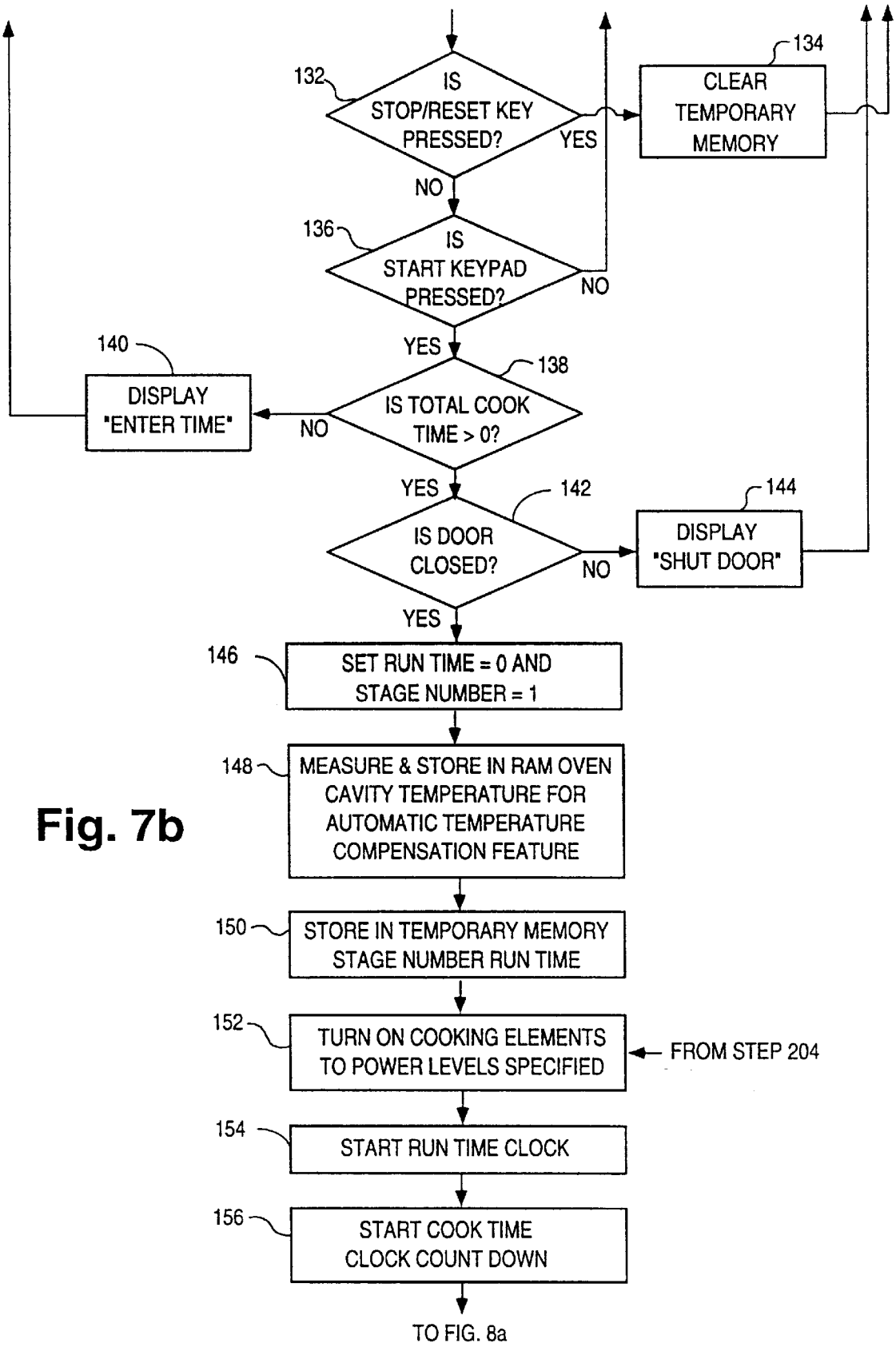
Figure 8:
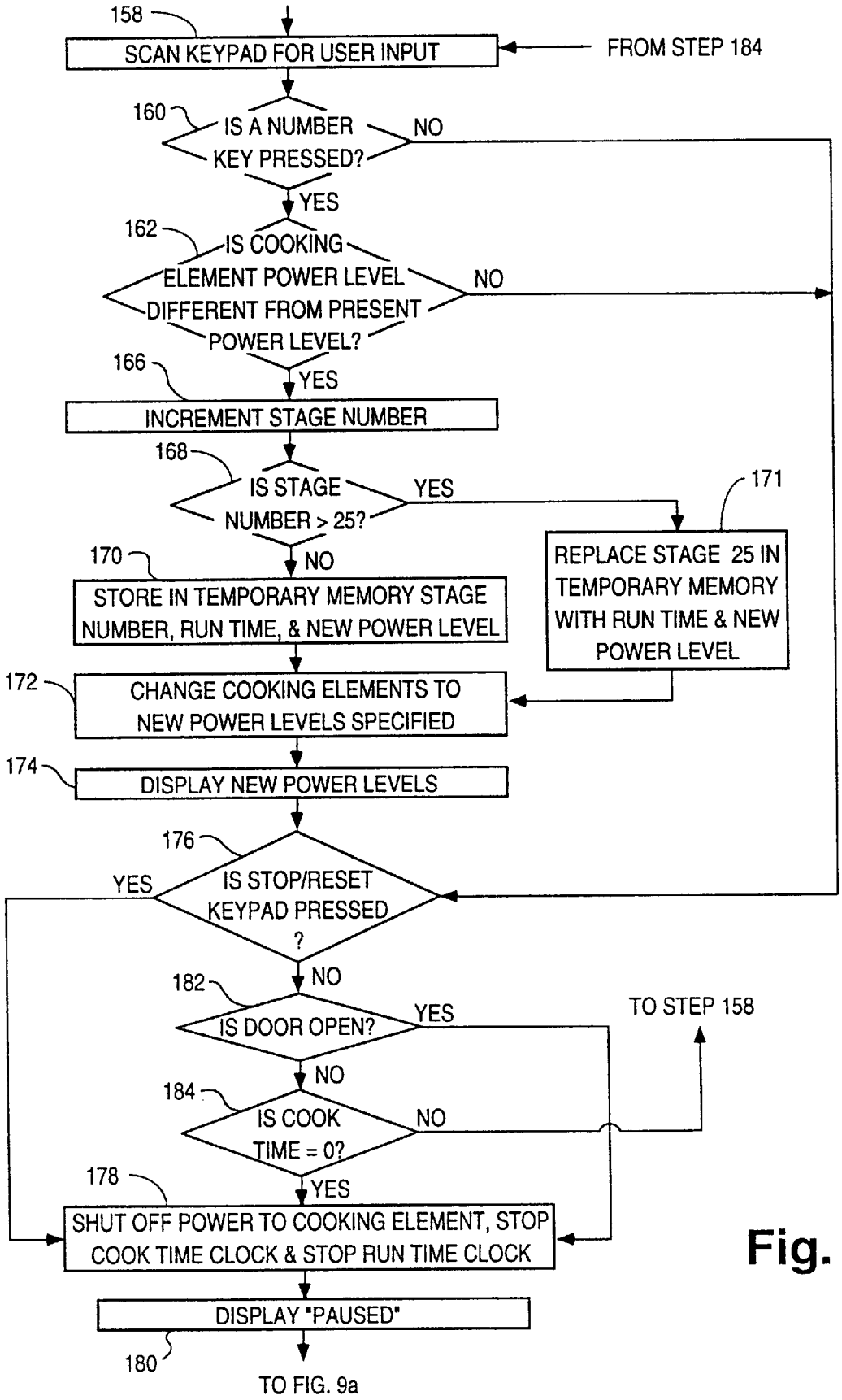
FIG. 8 is a flow diagram of the changing of the power levels of the radiant cooking elements during the cooking cycle according to the present invention.
Figure 9A:
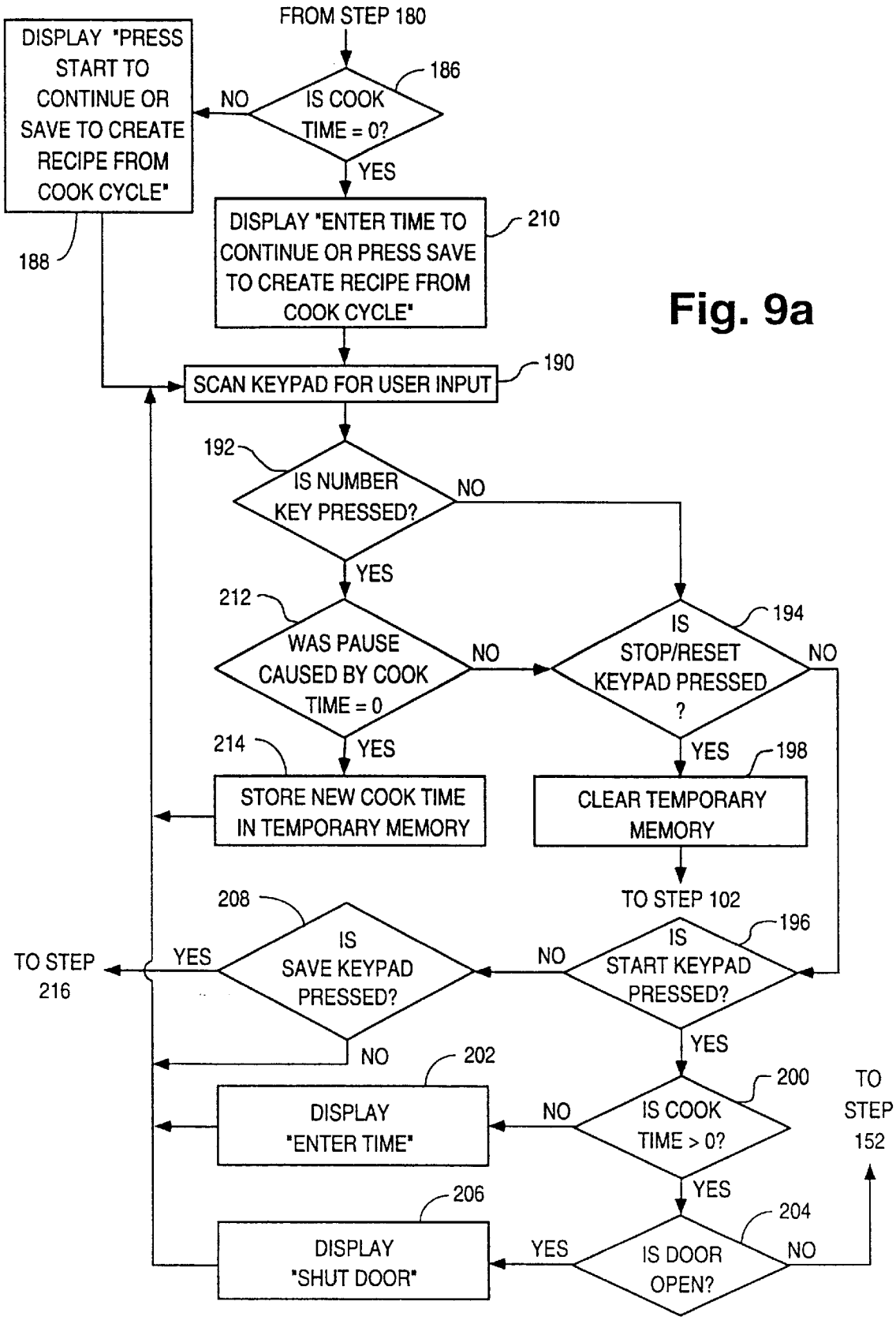
FIGS. 9*a* and *b* are flow diagrams of continuing the cook time after a pause or extending the cook time and finally saving the developed and optimized recipe according to the present invention.
Figure 9B:
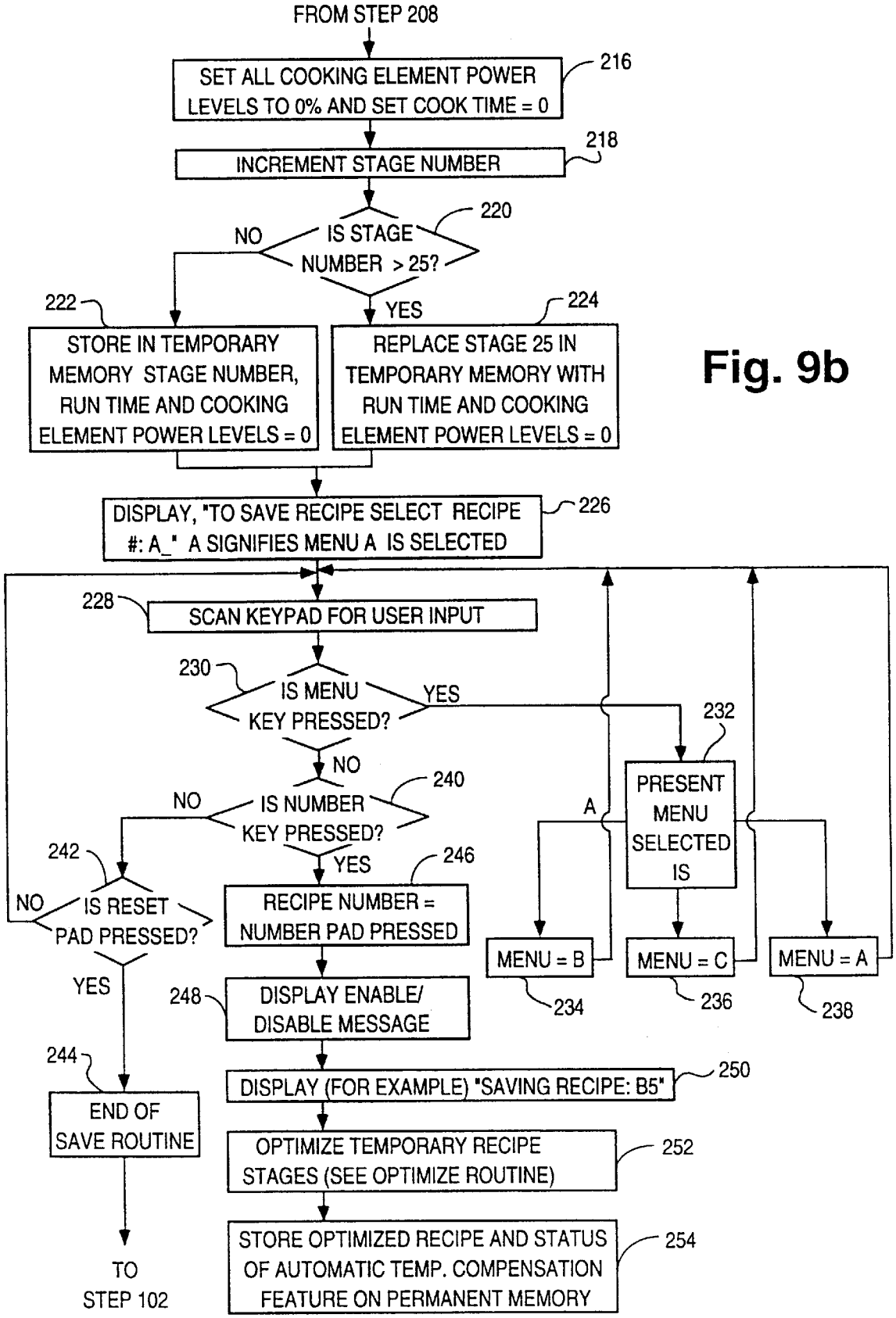
Figure 11:
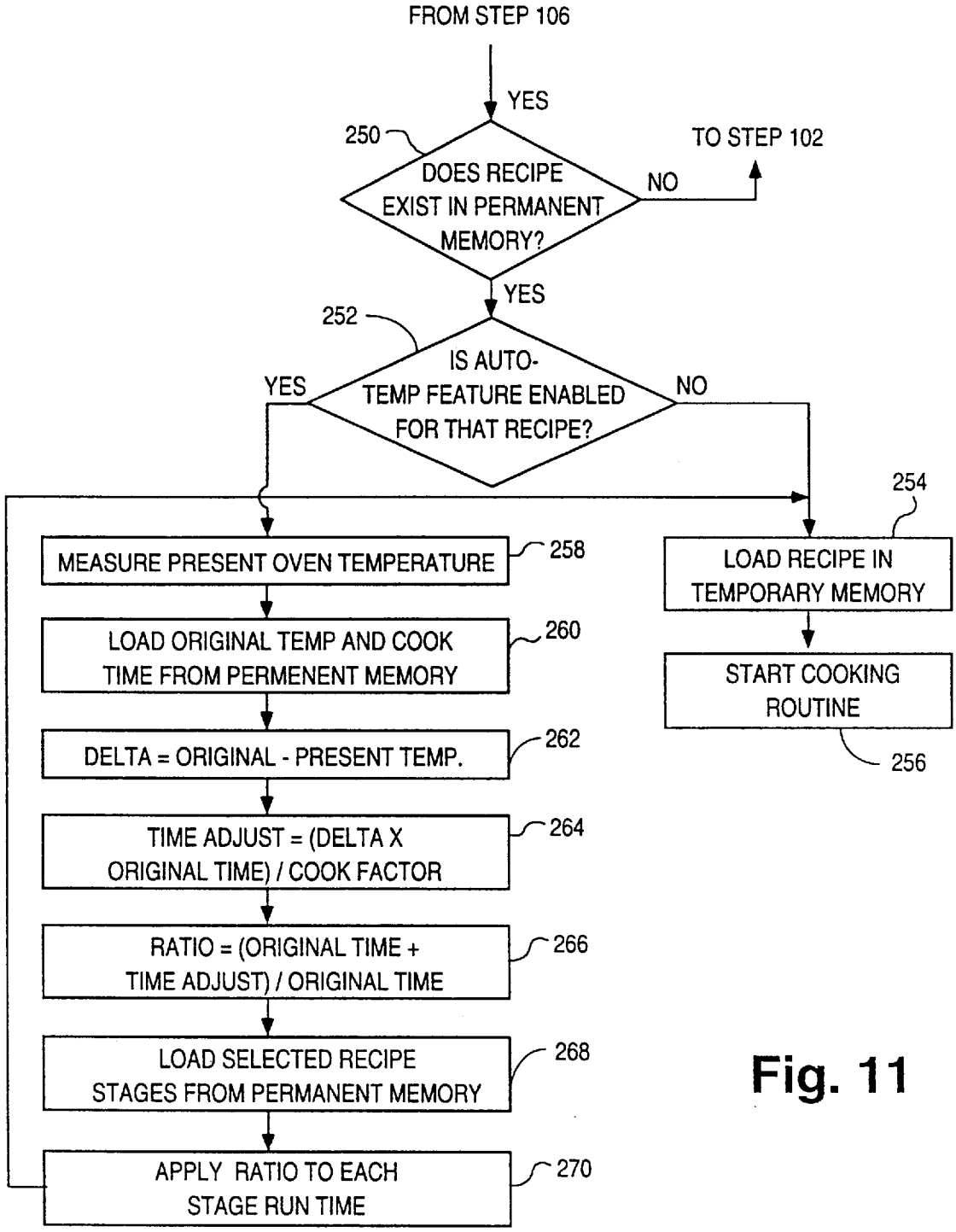
FIG. 11 is a flow diagram of the retrieval of a stored recipe from memory according to the present invention and of an automatic temperature compensation feature used with the present invention.

The preferred method or process of original recipe development is illustrated by the flow chart of FIGS. 7*a* and *b*. At step 100 the user turns on the overall power to the oven 10 by depressing the power key 36 on the control panel 18. The display screen 22 shows that the oven is ready at step 102 for either original recipe development or the selection of already stored recipes in menu A, refer to FIG. 5*a*. Now at step 104 the keypad comprising the control panel 18 and the bank of switches 20 is scanned to detect user input. If the user selects a recipe previously stored in memory at step 106 by pressing a number key 60 which identifies the stored recipe as latter explained, then the process continues as explained with reference to FIG. 11. If a stored recipe is not selected the user is going to develop a new recipe and the time entry key 38 is depressed and detected at step 108. If the time entry key 38 is not pressed then the process continues to scan the keypad for user inputs at step 104. If the time entry key 38 is pressed a temporary memory, typically a random access memory (RAM) which saves user inputs is cleared at step 110. Next, at step 112 all of the high power radiant cooking elements are set for operation at 100% intensity or power level and the total cook time is set to zero. Of course, the intensity levels of the elements and the total cook time could be set to any value. Next, at step 114 the intensity level for each cooking element and the total cook time are shown on the display 22 as illustrated in FIG. 5*b*. The letter C refers to the top center radiant element, 32, the letter O refers to the top outside radiant element 30 and the letter B refers to the bottom radiant element 34. A cursor is flashing under the letter C to indicate that if the user changes intensity or power level as explained below that the cooking element changed will be the top center element 32. The cursor is moved by depressing the right and left arrow keys 54 and 56 on control panel 18.

Now the keypad is scanned for user inputs at step 116. Next at step 118 it is determined whether or not one of the keys 60 from switch bank 20 is depressed. If a number key 60 is not pressed the process continues to scan the keypad for user inputs at step 116. However, if a number key 60 is pressed the process moves to step 120 to determine whether or not a cooking element is selected. A cooking element is selected if the cursor is placed under the letter designation C, O or B. Of course, the cursor is moved to the left or right by depressing arrow keys 54 or 56 respectively. Typically the cursor is moved to the cooking element whose intensity level is to be changed before the number key 60 is pressed. The intensity level or output power level of the cooking element selected is changed from the originally selected 100% to whatever percentage is represented by the depressed number key 60. For example, if the user depresses the number 6 key 60 and the cursor is flashing under letter C, then the output power level of the center cooking element 32 is changed from 100% to 60%. The new intensity level is stored in the temporary memory (RAM) at step 122. Now, at step 124, the new intensity level is displayed on screen 22 as shown in FIG. 5*c*. The process now returns to step 116 and continues to scan the keypad for user inputs. The above process is repeated as needed to set the intensity level of each of the cooking elements 30, 32 and 34. For example, the user can move the cursor under the letter O by depressing the arrow key 54 and can then change the intensity of the outer cooking element 30 to 70% by depressing the number 7 key 60. The new intensity level for cooking element 30 is stored in temporary memory and displayed on screen 22. Now the user can move the cursor under the letter B by depressing the arrow key 56 and can then change the intensity of the bottom cooking element 34 to 50% by depressing the number 5 key 60. The new intensity level for the bottom cooking element 34 is stored in temporary memory and displayed on screen 22. The screen 22 now shows the intensity level of the center element 32 or C as 60%, the outer element 30 or O as 70% and the bottom element 34 or B as 50%. Of course, if the user desires to have one or more of the cooking elements at 100% intensity the user simply moves the cursor past that cooking element designation on the screen 22. If a cooking element is not selected at step 120 then the process determines if the cooking time is selected at step 126. The cooking time is selected by moving the cursor to be under the time indication. Again, the user moves the cursor to indicate cooking time before entering the desired total cooking time by depressing the appropriate keys 60. The new cooking time selected, for example, two minutes and thirty-three seconds, is stored in RAM at step 128 and shown in display 22 at step 130. At this point the initial power level or intensity of each cooking element 30, 32 and 34 and the original cook time are stored in temporary memory and illustrated on the display 22 as shown in FIG. 5*d*.

The process continues to scan the keypad for user input at step 116. If the stop/reset key 62 is pressed at step 132, then the RAM memory is cleared at step 134 and control of the process is returned to step 102 to display the "Ready" message on screen 22. If the stop/reset key 62 is not pressed, then at step 136 the process checks to determined whether or not the start key 64 is pressed. If the start key 64 is not depressed the process continues to scan the keypad for user input at step 116. If the start key 64 is pressed, then at step 138 it is determined whether or not the user has entered an appropriate cooking time. If the total cook time is not greater than zero, then the user did not enter the cook time and then at step 140 the message "enter time" is shown on the display 22 and control of the system is returned to step 116 for entry of the cook time. If a cook time has been entered, then the process moves to step 142 to determine whether the oven door is closed. If the door is not closed then at step 144 the message "shut door" is shown on the display and the process returns to step 116. If the oven door is closed, the process moves to step 146 where the cooking stage number is set to stage number 1 and the run time is set to zero. Each stage of the cooking cycle has a specific run time which indicates the beginning point of the stage, accordingly stage 1 has a run time equal to zero. It would also be possible to have each stage have a separate run time equal to the time period of that stage and, of course, subsequent changes to the process would be necessary to accommodate this change as would be well known to one of ordinary skill in the field. Now at step 148 the oven cavity temperature is measured by temperature probe 35 and stored in RAM for future use as is explained with reference to FIG. 11. Next at step 150 the stage number and the run time is stored in temporary memory or RAM. Finally at step 152 all cooking elements are turned on to the power levels specified. Now the run clock is started at step 154 to determine the total time of the stage and at step 156 the cooking time clock begins counting down the total cooking time.

Now the oven is operating and the user is able to view the food being cooked. The process is scanning the keypad for user inputs at step 158. If the user desires to change the power level of one of the cooking elements, the cursor is moved under the designation for the cooking element that is to be changed and the appropriate numeric key 60 is pressed. For example, if cooking element 30 is to be changed, the cursor is moved under the letter O on the display 22 by depressing the appropriate arrow keys 54 or 56 and if the current intensity level of 70% is to be changed to 60% intensity level, the number 6 key 60 is pressed. If the intensity level of the selected element is to be raised to 100% intensity, then 100% intensity key 40 on control 18 is depressed. Now, the process detects whether a number key 60 is depressed at step 160. If a number key is not pressed the process through a series of intermediate steps continues to scan the keypad at step 158. If a number key 60 is pressed, then at step 162, the process determines which one of the cooking elements is selected and if the new power level of the selected cooking element is different than the current power level. If the new power level is the same as the current power level the process through a series of intermediate steps continues to scan the keypad at step 158. If the new power level of the selected cooking element is different than the current power level then the stage number is incremented by one at step 166. A new stage is now in operation and at step 168 the number of stages is compared against a maximum limit of 25. Any numerical limit can be placed on the number of stages to allow flexibility and creativity to the user. If the stage number is not greater than the limit then at step 170 the run time for the new stage or the time at which the change was made, the new stage number and the intensity levels of the cooking elements are stored in temporary memory (RAM). For example, if the change in intensity level of cooking element 30 or O changed from 70% to 60% after 10 seconds of operation the process would store in temporary memory stage 2, run time equal 10, and intensity levels C equals 60%, O equals 60%, B equals 50%. If the stage number is greater than the limit at step 168 then at step 171 the new intensity levels and run time for stage 26 or greater are substituted for the intensity levels and run time for stage 25 stored in temporary memory. Next the selected cooking element is changed to the new power level at step 172 and the power levels of the cooking elements are displayed at step 174.

Now, at step 176 the stop/reset key 62 is checked, if the stop/reset key 62 is depressed, the power to the cooking elements is shut off and the run time and cook time are stopped at step 178 and the message "paused" is displayed at step 180. If the stop/reset key 62 is not depressed at step 176, then the condition of the door is checked at step 182. If the door is open the process moves to step 178 to shut off power to the cooking elements and stop the run time and cook time and the message "paused" is displayed at step 180. If the door is not open at step 182, then the cooking time is checked at step 184. If the cooking time is equal to zero then the process proceeds to step 178 and shuts off power to the cooking elements and the message "paused" is displayed at step 180. If the cooking time is not equal to zero then the process continues to scan the keypad for user inputs at step 158. The entire sequence is now repeated which enables the user to again modify the power level of one of the cooking elements to create another stage in the development of a recipe.

After step 180, the cooking time is checked at step 186 and if the cook time does not equal zero, which means that the power was shut off because the step/reset key 62 was pressed at step 176 or it was determined that the door was open at step 178, in either event the message "press start to continue or save to create a recipe from cooking cycles" is shown at display 22 at step 188. If the user wants to continue the start key 62 is pressed. If the user wants to save the developed recipe then the save key 48 is depressed. Both of these options are described below. The process at step 190 scans the keypad for user inputs. Next, at step 192 it is determined whether or not a number key 60 is pressed. If a number key 60 is not pressed then the process goes to step 194 to determine if the stop/reset key 62 is pressed. If the stop/reset key 62 is not pressed then the process advances to step 196 to determine if the start key 62 is pressed. If the stop/reset key 62 is pressed then the process advances to step 198 and the RAM memory is cleared and the process returns to step 102 and displays the "ready" message.

If the start key 62 at step 196 is pressed then the process determines whether the cook time is greater than zero at step 200. If the cook time is not greater than zero, then the process displays "enter time" at step 202 and returns to step 190 to scan the keypad for user inputs. If the cook time is greater than zero, then the process goes to step 204 to determine whether or not the door is open. If the door is open then at step 206 the message "shut door" is displayed and the process returns to step 190 to scan the keypad for user input. If the door is not open at step 204, then the process returns to step 152 to turn on the cooking elements to the power level specified.

If the start key 62 is not pressed at step 196 then the process advances to step 208 to determine whether or not the save key 48 is pressed. If the save key 48 is not pressed the process returns to step 190 to scan the keypad for user input. Now, if the cook time at step 186 is equal to zero, then the original time set by the user has expired. The process now displays the message "Enter time to Continue or Press Save to Create Recipe for Cook Cycle" at step 210 and the process scans the keypad for user input at step 190.

If a number key 60 is pressed at step 192, the process determines if the pause at step 180 was initiated by the cooking time being equal to zero at step 212. If the pause was not initiated by the cooking time being equal to zero then the process checks if the stop/reset key 62 is pressed at step 194 and continues as described above. If the pause was initiated by the cooking time being equal to zero then at step 214 the cooking time is increased by the amount entered by depressing the number key 60 and the new cook time is stored in temporary memory. Of course, to continue with the expanded cook time, the user depressed the start key 64 which is detected at step 196.

If the save key 48 is pressed at step 208 then all cooking element power levels are set to zero and the cooking time is reset to zero at step 216. Next at step 218 the stage number is incremented and at step 220 the new stage number is compared to the predetermined limit. If the last stage number is less than the predetermined limit then at step 222 the last stage number, the run time and the cooking element power levels of zero are stored in the temporary memory. If the last stage number is greater than the limit, then at step 224 the cooking element power levels and run time of stage 25 replace with the last stage data in the temporary memory. Now, the process advances to the optimization process at step 226.

At step 226 the message "To Save Recipe Select Recipe #A_" is displayed on screen 22 if the A menu is active. Of course, if the B or C menu is active the message refers to that active menu. The keypad is now scanned for user input at step 228. If the user desires to select a different menu the menu key 42 is pressed. This is detected at step 230. The present menu selected is detected at step 232. If the present menu is A, then at step 234 the menu B is selected. If the present menu is B, then at step 236 the menu C is selected. If the present menu is A, then at step 238 menu A is selected. By following the above sequence the user selects the menu in which the developed recipe will be stored.

Now at step 240, the process checks to determine if a number key is pressed. If the user hasn't depressed a number key 60 the process checks to determine if the reset key 62 is pressed at step 242. If the user presses the reset key 62, the save process ends at step 244 and the process returns to step 102 to display the ready message. If the reset key is not pressed, the process continues to scan the keypad for user input. If a number key 60 is pressed, the recipe number is made equal to the number key 60 pressed at step 246. The process now displays a message such as "enable/disable auto temp feature" on screen 22 at step 248. The cursor initially is positioned under the word "enable" and to select enabling of the automatic temperature compensation feature the user depresses enter key 50. If the user desires to disable this feature the right arrow key 56 is pressed moving the cursor under the word "disable". Now, the user presses enter key 50. Now, at step 250, a message such as "saving recipe: B5" is displayed on screen 22. Of course, the message displayed on screen 22 will reflect the menu and key pressed by the user. The process now goes to the optimization process at step 252. Finally, the optimized recipe and the status of the automatic temperature compensation feature is stored in permanent memory designated by the menu and key 60 selected at step 254.

An example of a developed recipe store in temporary memory is set forth in Table 1 below.

TABLE 1

TEMPORARY MEMORY

| | | POWER LEVELS | | |
|---|---|---|---|---|
| STAGE NO. | RUN TIME | C | O | B |
| 1 | 0 | 60 | 70 | 50 |
| 2 | 10 | 60 | 60 | 50 |
| 3 | 12 | 60 | 60 | 40 |
| 4 | 45 | 60 | 60 | 0 |
| 5 | 68 | 60 | 60 | 100 |
| 6 | 72 | 60 | 20 | 100 |
| 7 | 80 | 20 | 20 | 100 |
| 8 | 120 | 30 | 20 | 100 |
| 9 | 125 | 100 | 100 | 100 |
| 10 | 148 | 100 | 100 | 30 |
| 11 | 153 | 0 | 0 | 0 |

The optimization process shown on FIGS. 10*a* and 10*b* reduces the number of stages developed by the user to six stages by eliminating stages that have a very short run time. Of course, the number of stages selected for the optimized recipe is a matter of design choice. The basic premise of the optimization process is to eliminate stages during which the changes to the intensity level of the cooking elements will have no practical impact on the food being cooked because the run time is so short and to reduce the amount of permanent memory needed to store a recipe. Very short run times can occur if the user desires to change the intensity level of two of the cooking elements. Following the process described above and referring to Table 1 of a typical temporary memory at stage 2 the user has changed the intensity level of the outside cooking element 30 or O from 70% to 60% at run time equal to 10 seconds. Now, promptly after making the change resulting in stage 2 the user changes the intensity level of the bottom cooking, element 34 from 50% to 40% at run time equal to 12 seconds. This is basically as fast as the user can operate the keypad to change intensity levels. Now, if stage 2 were eliminated the only difference would be that the intensity level of cooking element 34 or B remains at 50% for two additional seconds before being changed to 40%. Thus, the elimination of stage 2 will have practically no affect on the food being cooked.

The optimization process is described with reference to the flow diagram of FIGS. 10*a* and 10*b*. At step 300 the minimum stage duration or "filter" is set to five seconds. The user has no control over this predetermined time period as it is selected by the manufacturer. The stage duration or filter time is a matter of design choice. Next at step 302 the "Last Stage" parameter is set equal to the last stage entered into the temporary memory during the cooking cycle. Using the cooking cycle from the above Table "Last Stage"=11. Now, at step 304 the number of "Stages to Delete" is set to 0. At step 306, a transition memory is cleared. The transition memory is typically a random access memory (RAM)and it stores each stage of the optimized recipe during the optimization process before the optimized recipe is loaded into the permanent memory (ROM). At step 308, the Last Stage is compared to the maximum number of stages. In the example, the Last Stage or 11 is compared to the preselected maximum number of stages or 6. If the number of stages in the developed recipe were less than the maximum number of stages allowed then the process loads the stages stored in the temporary memory into the transition memory at step 310. Now, at step 312, the stages stored in the transition memory are loaded into permanent memory and the optimization process ends at step 314.

If the number of stages in the developed recipe is greater than the maximum number of stages allowed, optimization is necessary. At step 316 the "Stages to Delete" is set equal to the Last Stage minus the maximum number of stages allowed. In the example, Stages to Delete=11−6. Now, at step 318, the Stages Deleted is set equal to 0. Next, at step 320, it is determined if the number of Stages Deleted is less than the number of Stages to Delete. Since in the example, Stages Deleted (0) is less than Stages to Delete (5) the process moves to step 322, where the minimum stage duration allowed or filter time is increased by one second and the Stages Deleted is set to zero. The filter time is increased at this point even though the original filter time has not been used in the optimization process. Now, at step 324, the Stage No. N is set equal to 2. The first stage to be processed through the optimization sequence is the second stage stored in the temporary memory. Next, at step 326, the Stage N is compared to the last stage. In the example, N=2 and Last Stage=11 and since 2 is less than 11 the process moves to step 328.

Now, the run time of the developed recipe stored in temporary memory at Stage N minus the filter time is compared to the run time of the developed recipe at stage N−1. In the example, the run time for the developed recipe in temporary memory at stage 2 is 10 seconds and the filter time is 6 seconds and the run time for the developed recipe in temporary memory at stage 1 is 0 seconds, so that 10−6 or 4 is not less than or equal to 0. Accordingly, the process moves to step 330 and N is incremented. The process now returns to step 326 to determine if N is less than the last stage. N is now equal to 3 and the Last Stage is still 11. Accordingly, the process again proceeds to step 328. During this cycle the run time for the developed recipe in temporary memory at stage 3 minus the filter time is compared to the run time of developed recipe in temporary memory at stage 2. The run time for stage 3 is twelve seconds so 12−6=6 and the run time for stage 2 is 10 seconds. Since 6 is less than or equal to 10, the process moves to step 332 where the stages deleted is incremented. The process increments N at step 330 and returns to step 326 to begin another sequence. If the above process is followed for the sample developed recipe in the Table the stages deleted equals 4 through N=10, N=11 and at step 326 since N is not less than the Last Stage and the process moves to step 330. Since the stages deleted (4) is still less than the stages to delete (5), the process moves to step 322 to repeat the above process with the filter time increased by 1 so that filter time=7 seconds and stages deleted reset to 0. After this sequence is completed, stages deleted=5.

The process now at step 320, determines that stages deleted is not less than Stages to Delete and proceeds to step 334. Now, Stage No. X is set equal to 1 and Stage No. Y is set equal to 2. Next, at step 336, Y is compared to the last stage number stored in temporary memory. If Y is not greater, then the process moves to step 338. Now, the run time of the developed recipe stored in temporary memory at Stage Y−1 is compared to the run time for the developed recipe stored in temporary memory at Stage Y minus the filter time. In the present example, Y=2 and Filter time=7 seconds and the run time of stage 1=0 and the run time of stage 2=10. Since the run time for Stage Y−1 (0) is less than the run time for Stage Y (10) minus filter time (7) the process proceeds to step 340. The stage (Y−1) stored in temporary memory is now loaded into the transition memory at Stage X. In the example, stage 1 in the temporary memory is stored as stage 1 in the transition memory. Now at step 342 X is incremented and at step 344 Y is incremented and the process returns to step 336. Y now equal to 3 is still not greater than the Last Stage (11) so the process goes to step 338.

The run time for the developed recipe at Stage Y−1 is compared to the run time for the developed recipe at Stage Y minus the filter time. The run time for stage 2 is 10 seconds, the run time for Stage 3 is 12 seconds and the filter time is 7 seconds. Accordingly, 10 is not less than 12−7 and the process moves to step 344 to increment Y. The data stored in temporary memory for the developed recipe at stage 2 is not loaded into the transition memory since the run time between stage 2 and stage 3 is too small.

The process now returns to step 336 with Y=4 and X=2. Since Y is still not greater than the Last Stage (11) at step 338 the run time for the developed recipe in temporary memory at stage 3 is compared to the run time for the developed recipe in temporary memory at stage 4 minus the filter time. Accordingly, 12 is less that 45−7 and at step 340 the data in the temporary memory for stage 3 is loaded into the transition memory at stage 2. Now, X is incremented to 3 at step 342 and Y is incremented to 5 at step 344. The process again returns to step 336 to repeat until Y is incremented to 12. Now Y is greater than the Last Stage in temporary memory at step 336 and the process moves to step 346. Now, the data in the Last Stage of the temporary memory is loaded into the transition memory at stage X=6. Now the process proceeds to step 312 and the data in the transition memory is loaded into the permanent memory and the optimization process ends at step 314.

During the above optimization process the data for the developed recipe stored in temporary memory at stages 2, 5, 6, 8 and 10 has not been transferred to the transition memory. The transition memory has the following six stages:

TABLE 2

TRANSITION MEMORY

| | | POWER LEVELS | | |
|---|---|---|---|---|
| STAGE NO. | RUN TIME | C | O | B |
| 1 | 0 | 60 | 70 | 50 |
| 2 | 12 | 60 | 60 | 40 |

TABLE 2-continued

| TRANSITION MEMORY | | | | |
|---|---|---|---|---|
| | | POWER LEVELS | | |
| STAGE NO. | RUN TIME | C | O | B |
| 3 | 45 | 60 | 60 | 0 |
| 4 | 80 | 20 | 20 | 100 |
| 5 | 125 | 100 | 100 | 100 |
| 6 | 153 | 0 | 0 | 0 |

The data stored in the transition memory or RAM is stored in permanent memory or ROM. The process of developing a recipe in real time, optimizing the recipe and storing the recipe in permanent memory is now complete.

The user can select a recipe stored in permanent memory at step 106 by depressing a number key 60. If a number key is not pressed scanning the keypad continues at step 104. If a number key 60 is pressed by the user, then at step 250 in FIG. 11 the process checks the permanent memory to determine if a recipe is stored in that location. As described above, the user can select other menus by depressing the menu key 42. If the permanent memory location does not contain a recipe the process returns to step 102 to display the ready message. Of course, in addition to developed recipes stored in permanent memory the manufacturer can store standard recipes in permanent memory. A standard recipe is for a common food item to be cooked and is developed by the manufacturer. These standard recipes can be selected by the user in the same fashion that developed recipes are selected. If a recipe is stored in the permanent memory location, the process at step 252 checks to determine if the automatic temperature compensation feature is enabled.

The automatic temperature compensation feature is used to adjust the recipe depending upon the difference between the oven cavity temperature when the recipe was developed and the current oven cavity temperature. If the current oven cavity temperature is higher than the temperature when the recipe was developed, the retrieved recipe without compensation may burn the food. In a similar vein, if the oven cavity temperature when the recipe was developed was greater than the current temperature, the retrieved recipe without compensation may leave the food undercooked. The automatic temperature compensation feature proportionally adjusts the run time of each stage of the stored recipe to take into effect the temperature of the oven cavity.

If the automatic temperature compensation is not enabled for the recipe selected then at step 254 the selected recipe from permanent memory is loaded into temporary memory and as is well known by those of ordinary skill in the art the cooking routine is begun at step 256. If the automatic temperature compensation feature is enabled then the present oven cavity temperature is measured at step 258. Now, at step 260 the original oven cavity temperature and cook time stored in permanent memory is loaded into temporary memory. The difference between the original oven cavity temperature and the present oven cavity temperature is calculated as Delta in step 262. For example, if the original temperature was 80° F. and the current temperature is 195° F. perhaps due to prior operation of the oven, then Delta=80° F.−190° F.=−115° F. Now, the cook time adjustment is calculated at step 264 to be Delta times the original overall cooking time divided by the Cook Factor. For example, the original cook time was 153 seconds and the Cook Factor is 748. Accordingly, time adjust=(−115×153)/748=−23. Since the process does not require a high degree of accuracy the time adjust is rounded to the nearest integer. Now, at step 266, the Ratio is calculated as the original cooking time plus the time adjust divided by the original cooking time. For example, in this situation, 153+(−23)/153=0.84. At step 268, the stage data from the selected recipe is loaded into temporary memory. Now, at step 270 the Ratio is multiplied times the run time of each stage of the selected recipe and at step 254 loaded into temporary memory. Now, the cooking routine starts at step 256. The automatic temperature compensation process applied to the example of a developed recipe discussed above would result in the following auto-temp. compensated temporary memory.

TABLE 3

| AUTOMATIC TEMPERATURE COMPENSATED RECIPE | | | | |
|---|---|---|---|---|
| | | POWER LEVELS | | |
| STAGE NO. | RUN TIME | C | O | B |
| 1 | 0 | 60 | 70 | 50 |
| 2 | 10 | 60 | 60 | 40 |
| 3 | 38 | 60 | 60 | 0 |
| 4 | 67 | 20 | 20 | 100 |
| 5 | 105 | 100 | 100 | 100 |
| 6 | 128 | 0 | 0 | 0 |

Figure 12:
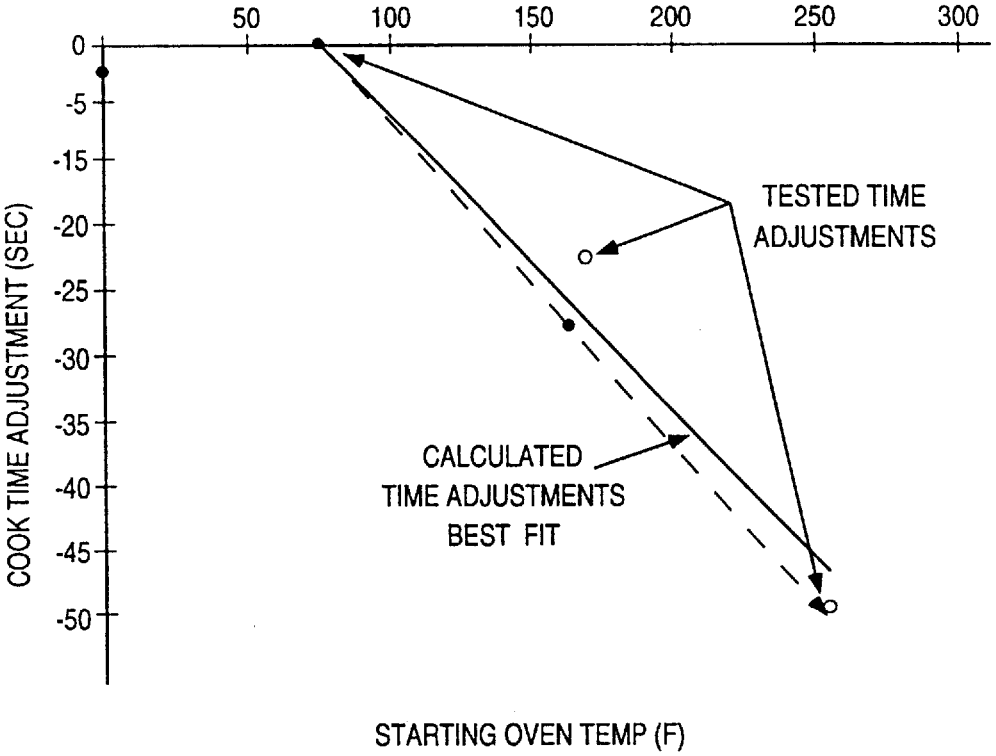
FIG. 12 is a graph showing a portion of the calculation of the Cook Factor for the automatic temperature compensation process used with the present invention.

The Cook Factor is an empirically derived number and may vary depending upon the thermal characteristics of the oven. In order to determine the Cook Factor a recipe developed with an oven cavity temperature of ambient or 74° C. and an overall cooking time of 210 seconds is cooked with an oven temperature in the mid range, for example, 163° F. and the amount of time that the overall cooking time must be reduced in order to obtain a properly cooked food product is noted on a graph as shown in FIG. 12. For example, the overall cooking time must be reduced by 19 seconds. The ordinant or y-axis is measured in seconds that the cook time adjustment factor is changed and the abscissa or x-axis is the oven cavity starting temperature in degrees Fahrenheit (°F.). Now, the same recipe is used with the oven cavity temperature in the high range for example 252° F. and the amount of time that the overall cooking time must be reduced in order to obtain a properly cooked food product is noted on the graph as shown in FIG. 12. For example, the overall cooking time must be reduced by 49 seconds. Any recipe can be used for this process and a minimum of three test points must be used as shown in FIG. 12. However, more test points can be used. Since the amount of time that the overall cook time must be reduced to get a properly cooked food is a subjective determination made by the operator, the more test points used the more accurate the result. Since the three test points do not lie on a straight line a best linear fit calculation is applied to obtain the solid time shown in FIG. 12.

Figure 13:
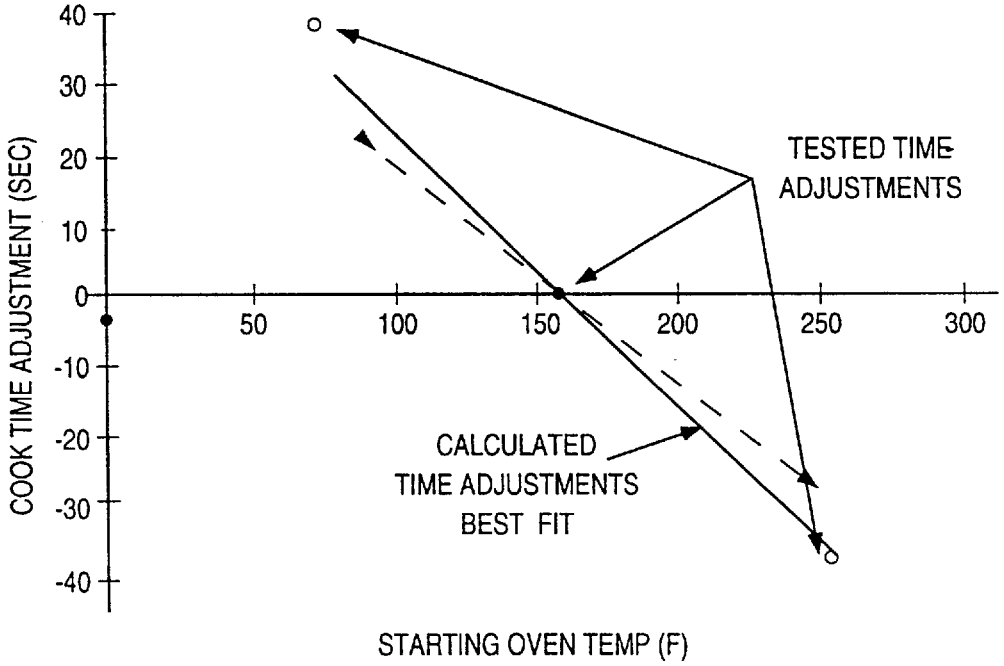
FIG. 13 is a graph showing a portion of the calculation of the Cook Factor for the automatic temperature compensation process used with the present invention.

Now, another recipe with an oven cavity temperature in the midrange, for example 163° F. and an overall cooking time of 225 seconds is cooked with the oven cavity temperature of ambient or 74° F. and the amount of time that the overall cooking time must be increased in order to obtain a properly cooked food product is noted on a graph as shown in FIG. 13. For example, the overall cooking time must be increased by 37 seconds. Now, the same recipe is used with the oven cavity temperature in the high range, for example 252° F. and the amount of time that the overall cooking time must be reduced in order to obtain a properly cooked food product is noted on the graph as shown in FIG. 13. For example, the overall cooking time must be reduced by 35 seconds. Again, since the three test points do not lie on a straight line a best linear fit calculation is applied to obtain the solid line shown in FIG. 13.

Figure 14:
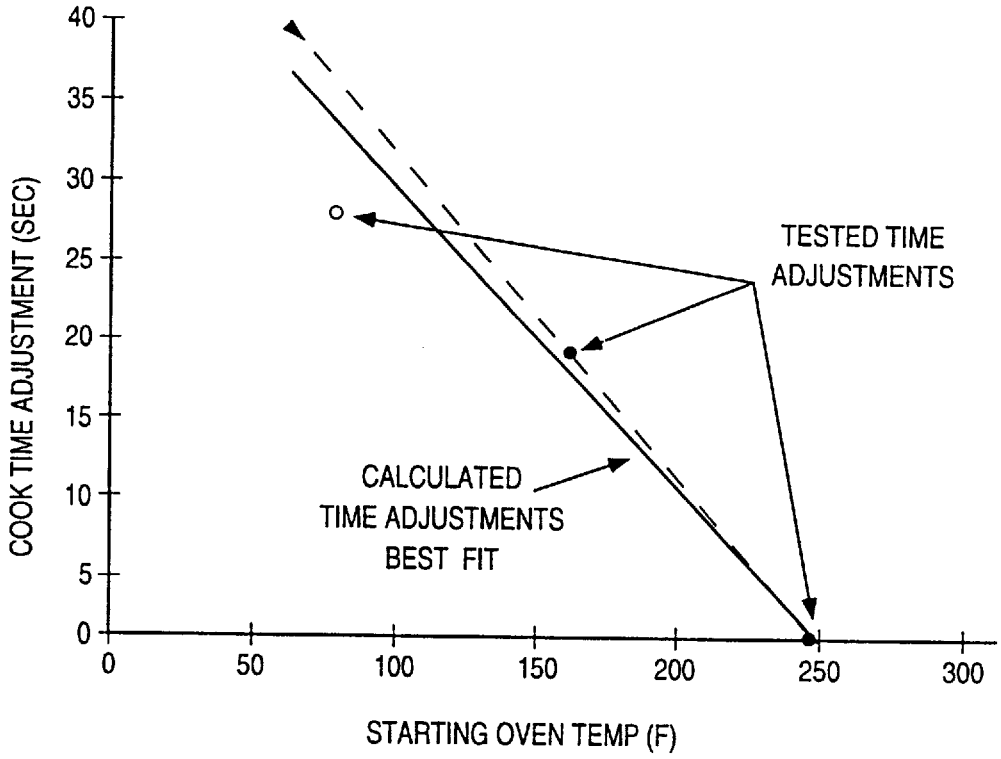
FIG. 14 is a graph showing a portion of the calculation of the Cook Factor for the automatic temperature compensation process used with the present invention.

Now, another recipe with an oven cavity temperature in the high range, for example 252° F. and an overall cooking time of 170 seconds is cooked with an oven cavity temperature of ambient or 74° F. and the amount of time that the overall cooking time must be increased in order to obtain a properly cooked food product is noted on a graph as shown in FIG. 14. For example, the overall cooking time must be increased by 32 seconds. The same recipe is used with the oven cavity temperature in the mid range, for example 163° F. and the amount of time that the overall cooking time must be increased to get a properly cooked food product is noted on the graph as shown in FIG. 14. For example, the overall cooking time must be increased by 20 seconds. Again, since the three test points do not lie on a straight line a best linear fit calculation is applied to obtain the solid line as shown in FIG. 14.

While three sample recipes with different oven cavity temperatures are described in the above examples, more sample recipes can be used which would increase the accuracy of the process. Furthermore, the performance of the best linear fit calculation to obtain the solid lines in FIGS. 12, 13 and 14 is within the ability of one of ordinary skill in the field.

Using the best linear fit line in each graph, the cooking time adjustment for each recipe is determined. Table 4 shows the oven cavity temperature for each recipe, the cooking time adjustment determined by test, the cooking time adjustment based upon the best linear fit line and average cooking time adjustment as explained below.

TABLE 4

COOK FACTOR CALCULATION

| OVEN CAVITY | COOKING TIME ADJUSTMENT (SEC.) | | |
|---|---|---|---|
| TEMP °F. | TESTED | BEST FIT | AVE. |
| 74 | 0 | 0 | 0 |
| 163 | −19 | −23 | −25 |
| 252 | −49 | −46 | −50 |
| 74 | 37 | 33 | 27 |
| 163 | 0 | 0 | 0 |
| 252 | −35 | −34 | −27 |
| 74 | 32 | 37 | 40 |
| 163 | 20 | 18 | 20 |
| 252 | 0 | 0 | 0 |

Now, using the best linear fit cooking time adjustment, the Cook Factor for each of the above six non-zero examples is calculated as Cook Factor equals the Original Oven Cavity Temperature minus Oven Cavity Temperature times the Original Overall Cooking Time divided by the best linear fit time adjustment factor. The average Cook Factor for all six examples is 745. Now, the average cooking time adjustment factor is calculated for each example using the average Cook Factor of 745. The average cooking time adjustment factor for each example is rounded to the nearest integer, refer to Table 4. The average cooking time adjustment factors are shown by the dotted line in each of the graphs in FIGS. 12, 13 and 14. Now, using the average cooking time adjustment factor rounded to the nearest integer, the Cook Factor for each of the six samples is determined and then the average Cook Factor is determined, in this example the average Cook Factor using the average cooking time adjustment factor rounded to the nearest integer is 748.

Figure 15:
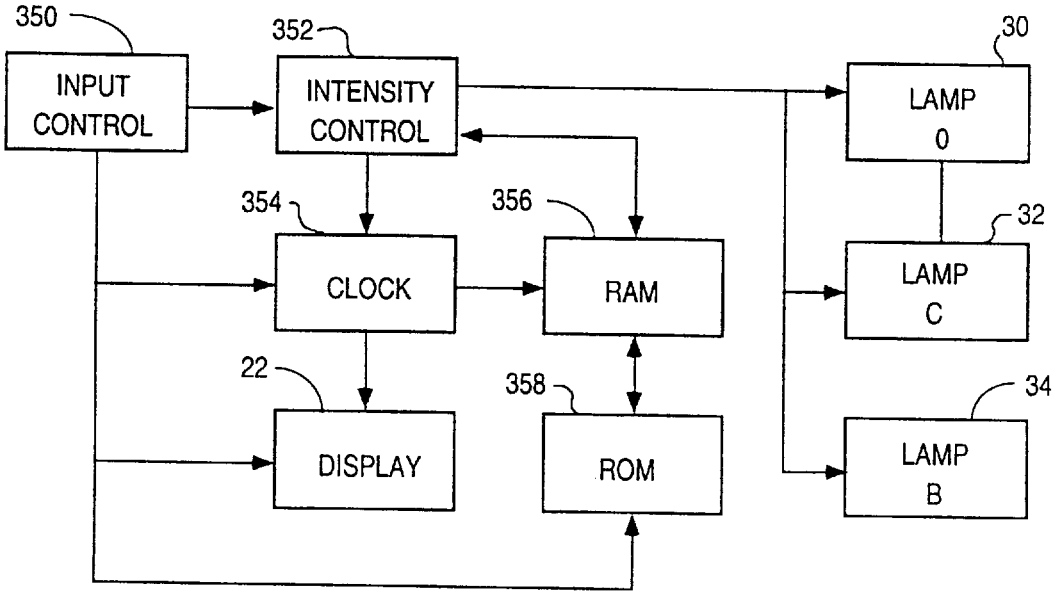
FIG. 15 is a block diagram of a control system for an oven using radiant energy elements according to the present invention.

FIG. 15 is a block schematic diagram of the overall oven control as described by the flow diagrams of FIGS. 7 through 11. The user operates the input control 350 comprising the control panel 18 and the bank of switches 20. The input control 350 sends a signal to the intensity control 352 for the radiant energy cooking elements 30, 32 and 34. The intensity control comprises solid state switching devices such as triacs and would be well known to one of ordinary skill in the field and is connected directly to the radiant energy cooking elements 30, 32 and 34. The input control 350 also sends a signal to the clock means 354 to set the overall cook time and run time. The intensity level of each cooking element at time equal to zero is stored in RAM memory 356 for temporary storage. The overall cook time, run time and oven cavity temperature are also stored in RAM memory 356. The intensity level of each cooking element and the overall cook time is shown in display 22. During the cook cycle the user can change the intensity level one of the cooking elements, the new intensity level and the time the change was made are stored in RAM memory as another stage in the recipe. The user can make additional changes to the intensity level of one of the cooking elements until the cook time elapses or the power to the cook elements is shut off. The stages of the recipe stored in RAM memory are now transferred to ROM memory 358. The user through the input control can retrieve a stored recipe from ROM memory 358 to control the oven 10.

It will be understood that various changes in the details, arrangements and configurations of the parts and assemblies which have been described and illustrated above in order to explain the nature of the present invention may be made by those of ordinary skill in the art within the principle and scope of the present invention as expressed in the appended claims. It is not intended to limit the invention to the precise forms disclosed above and many modifications and variations are possible in light of the above teachings. A program listing for the method of developing, optimizing, storing and retrieving recipes for the operation of an oven having high power radiant cooking elements in accord with the present invention follows:

```
1   /*****************************************************************************************************
2   **                                                                                                  **
3   **                                                                                                  **
4   **                                                                                                  **
5   **                                                                                                  **
6   **                                                                                                  **
7   **                    Copyright (C) 1996  Amana Refrigeration, Inc.  All Rights Reserved            **
8   *****************************************************************************************************
9   **                                                                                                  **
10  **                                                                                                  **
11  **                                                                                                  **
12  *****************************************************************************************************/
13
14  # include <oven.h>
15  # include <h338.h>
16
17  # include <eeprom.h>
18  # include <display.h>
19  # include <lamps.h>
20  # include <recipes.h>
21  # include <service.h>
22  # include <util.h>
23
24  /*****************************************************************************************************
25  **                                Function Prototypes (Modes of Operation)                          **
26  *****************************************************************************************************/
27
28  int  Standby(int keypad);                          /* standby mode of operation */
29
30  int  TimeEntry(int keypad);                        /* cooking modes */
31  int  ManualCooking(int keypad);
32  int  RecipeCooking(int keypad);
33  int  Pause(int keypad);
34
35  int  Programming(int keypad);                      /* recipe programming modes */
36  int  SelectRecipe(int keypad);
37  int  SelectName(int keypad);
38  int  StageEntry(int keypad);
39  int  RecipeExists(int keypad);
40  int  AccuTime(int keypad);
41  int  SaveRecipe(int keypad);
42  int  DeleteRecipe(int keypad);
43
44  int  ModifyOptions(int keypad);                    /* modify user option programming modes */
45  int  ToneSelect(int keypad);
46  int  SignalEnable(int keypad);
47  int  KeySensitivity(int keypad);
48  int  AddTime(int keypad);
49  int  DefaultTime(int keypad);
50
51  int  OverTemp(int keypad);
52  int  CheckShields(int keypad);
53  int  CheckLamps(int keypad);
54  int  CleanOven(int keypad);
55
56  /*****************************************************************************************************
57  **                                        Enumerated Constants                                      **
58  *****************************************************************************************************/
59
60
61  enum    {STAGE_FLD, TIME_FLD, CENTER_FLD, OUTER_FLD, BOTTOM_FLD};          /* display fields */
62
63  enum    {PAUSE_TIME_ENTRY_COOK, CONT_TIME_ENTRY_COOK, PAUSE_RECIPE_COOK};   /* pause/continue modes */
64
65
66  /*****************************************************************************************************
67  **                                          Global Variable                                         **
68  *****************************************************************************************************/
69
70  char      menu = 'A';
71  char      recipe_num = 0;
72
73  int       oven_temp = 80;
74  int       start_temp = 80;
75
76  int       voltage;
```

```
77  int        current;
78  int        amps;
79  int        watts;
80
81  int        cook_time;
82  int        run_time;                          /* run time counter for recipe development */
83
84  char       stage_entry;
85  char       stage_num;
86  char       prev_cooking_mode;                 /* flag for pause/continue mode */
87  char       program_mode;
88  char       clean_oven = FALSE;                /* clean oven flag */
89  char       check_lamp = FALSE;                /* check_lamp flag */
90  char       check_lamp_bot = FALSE;
91
92  char       message = 0;
93  long       message_ctr = 0L;
94  long       mode_ctr = 0L;
95  int        stuck_keypad_ctr = 0;
96
97  unsigned int  total_run_time;
98  int           thirty_min_ctr = 0;             /* counter for 30 min */
99
100 char       ctr_amp_adj;
101 int        center_watts;
102 int        center_volts;
103
104 char       out_amp_adj;
105 int        outer_watts;
106 int        outer_volts;
107
108 char       bot_amp_adj;
109 int        bottom_watts;
110 int        bottom_volts;
111
112 char       all_amp_adj;
113 int        all_watts;
114 int        all_volts;
115
116 char       volt_adj;                          /* compensate for varying suply voltages */
117
118 int        power[3];                          /* for use by lamp & irq routines only      */
119 int        pwr_level[3];                      /* current power lamp power levels          */
120 int        prev_pwr_level[3];                 /* previous power lamp power levels         */
121 int        temp_pwr_level[3];                 /* stores temporarily the lamp power levels */
122
123
124 char              version = 11;               /********* Software Version Number **********/
125 unsigned char     model;
126 unsigned char     detected_model;
127 char              service_code;
128
129 /************************************** User Option Variables ******************************************/
130
131 unsigned char      tone, signal_enable, key_sense, add_time, default_time;
132
133 /************************************** Interrupt Variables ********************************************/
134
135 char       freq_sampling = 0;
136 char       synced_atod_sampling = FALSE;      /* specifies whether A to D sampling is synced to line */
137 int        tot_samples;
138
139 int        line_freq, line_freq_count, seconds_old, seconds, ticks, pulse_cycle;
140 char       half_cycle_1, half_cycle_2, half_cycle_dif, soft_start, soft_start_stop, pending;
141
142
143 /************************************** Recipe Variables ***********************************************/
144
145 struct    header_struct          header;
146 struct    recipe_struct          recipe;
147 struct    temp_recipe_struct     temp_recipe;
148
149 /************************************** Static Variables ***********************************************/
150
151 static int     te_field[4] = { TE_CTR_POS, TE_OTR_POS, TE_BTM_POS, TE_TIME_POS };
152 static int     stage_field[5] = { ST_NUM_POS, ST_TIME_POS, ST_CTR_POS, ST_OTR_POS, ST_BTM_POS };
```

```
153
154
155 static char    *recipe_name[] =
156
157                 { "BEEF TENDERLOIN ",  "FILET MIGNON    ",
158                   "STEAK 1         ",  "STEAK 2         ",  "RIBS            ",
159                   "PORK CHOPS      ",  "LAMB CHOPS      ",  "HAMBURGER       ",
160                   "CHICKEN 1       ",  "CHICKEN 2       ",
161                   "FISH            ",  "FISH FILET      ",  "FISH STEAK      ",
162                   "SANDWICH 1      ",  "SANDWICH 2      ",  "STIR FRY        ",
163                   "FAJITA 1        ",  "FAJITA 2        ",  "QUESADILLA      ",
164                   "PIZZA 1         ",  "PIZZA 2         ",  "DEEP DISH PIZZA ",
165                   "POTATO SKINS    ",  "FRIES           ",  "NACHOS          ",
166                   "ENTREE 1        ",  "ENTREE 2        ",
167                   "APPETIZER 1     ",  "APPETIZER 2     ",
168                   "APPETIZER 3     ",  "APPETIZER 4     ",
169                   "SPECIALTY FOOD 1",  "SPECIALTY FOOD 2",
170                   "VEGETABLE 1     ",  "VEGETABLE 2     ",
171                   "OMELET          ",  "SAUSAGE         ",
172                   "MUSHROOMS       ",  "SHRIMP          "   };
173
174 static int     name_limit = 38;
175
176 /*****************************************************************************************************
177 **                                                  Main Loop                                        **
178 *****************************************************************************************************/
179 void main(void)
180   {
181     int           keypad, tco, shields;
182     int           mode;
183
184     mode = Initialize();                          /* Initialize  */
185
186     while (1)
187       {
188         keypad = ScanKeyPad();
189         oven_temp = ReadTemp();
190
191         tco = *P6_DR & 0x01;                      /* check the state of the TCO */
192         shields = *P6_DR & 0x04;                  /* check the placement of the shields */
193
194         mode = CheckForMessageModes(mode, tco);
195         mode = CheckForShutDownModes(mode, tco, shields);
196
197         FanControl(mode, tco);
198         WatchDogControl(mode);
199         LineVoltageAve(mode);
200
201         switch(mode)                              /* process the present mode */
202           {
203             case STANDBY_MODE:          mode = Standby(keypad);          break;
204
205             case TIME_ENTRY_MODE:       mode = TimeEntry(keypad);        break;
206             case MANUAL_COOKING_MODE:   mode = ManualCooking(keypad);    break;
207             case RECIPE_COOKING_MODE:   mode = RecipeCooking(keypad);    break;
208             case PAUSE_MODE:            mode = Pause(keypad);            break;
209
210             case PROGRAMMING_MODE:      mode = Programming(keypad);      break;
211             case SELECT_RECIPE_MODE:    mode = SelectRecipe(keypad);     break;
212             case SELECT_NAME_MODE:      mode = SelectName(keypad);       break;
213             case STAGE_ENTRY_MODE:      mode = StageEntry(keypad);       break;
214             case RECIPE_EXISTS_MODE:    mode = RecipeExists(keypad);     break;
215             case ACCU_TIME_MODE:        mode = AccuTime(keypad);         break;
216             case SAVE_RECIPE_MODE:      mode = SaveRecipe(keypad);       break;
217             case DELETE_RECIPE_MODE:    mode = DeleteRecipe(keypad);     break;
218
219             case MODIFY_OPTIONS_MODE:   mode = ModifyOptions(keypad);    break;
220             case TONE_SELECT_MODE:      mode = ToneSelect(keypad);       break;
221             case SIGNAL_ENABLE_MODE:    mode = SignalEnable(keypad);     break;
222             case KEY_SENSITIVITY_MODE:  mode = KeySensitivity(keypad);   break;
223             case ADD_TIME_MODE:         mode = AddTime(keypad);          break;
224             case DEFAULT_TIME_MODE:     mode = DefaultTime(keypad);      break;
225
226             case SERVICE_MODE:          mode = Service(keypad);          break;
227             case SERVICE_PAD_MODE:      mode = ServicePad(keypad);       break;
228             case TEST_INPUTS_MODE:      mode = TestInputs(keypad);       break;
```

```
229             case TEST_FAN_MO            mode = TestFan(keypad);          break;
230             case TEST_VOLTA     DE:     mode = TestVoltage(keypad);      break;
231             case TEST_TEMP_M    :       mode = TestTemp(keypad);         break;
232             case TEST_KEY_MODE:         mode = TestKey(keypad);          break;
233             case TEST_CENTER_MODE:      mode = TestCenter(keypad);       break;
234             case TEST_OUTER_MODE:       mode = TestOuter(keypad);        break;
235             case TEST_BOTTOM_MODE:      mode = TestBottom(keypad);       break;
236             case TEST_ALL_MODE:         mode = TestAll(keypad);          break;
237             case TEST_DISPLAY_MODE:     mode = TestDisplay(keypad);      break;
238             case CONFIG_MODE:           mode = Config(keypad);           break;
239             case REMCO_TEST_MODE:       mode = RemcoTest(keypad);        break;
240             case SERVICE_CODE_MODE:     mode = ServiceCode(keypad);      break;
241
242             case OVERTEMP_MODE:         mode = OverTemp(keypad);         break;
243             case CHECK_SHIELDS_MODE:    mode = CheckShields(keypad);     break;
244             case CHECK_LAMPS_MODE:      mode = CheckLamps(keypad);       break;
245             case CLEAN_OVEN_MODE:       mode = CleanOven(keypad);        break;
246
247             case DEMO_START_MODE:       mode = DemoStart(keypad);        break;
248             case DEMO_MODE:             mode = Demo(keypad);             break;
249
250             default:                                          break;
251           }
252
253       }   /* end of main while loop */
254
255   }       /* end Main  */
256
257
258 /*****************************************************************************************************
259 **      Standby MODE                    In this mode the oven is idle, waiting to direct a valid      **
260 **                                      keypad input                                                  **
261 *****************************************************************************************************/
262 int  Standby(int keypad)
263   {
264     int     nextmode = STANDBY_MODE;
265     char    valid_key = TRUE;                   /* determines whether or not to beep for key input */
266     char    test_pin_hi;
267
268     static int   test_pin_ctr = 0;
269
270     DisplayPrompt(menu);
271     PosString(26,"      *READY* ");
272
273     switch(keypad)
274       {
275         case PAD_0:
276         case PAD_1:
277         case PAD_2:
278         case PAD_3:
279         case PAD_4:
280         case PAD_5:
281         case PAD_6:
282         case PAD_7:
283         case PAD_8:
284         case PAD_9:
285           {
286             Beep(150,tone);
287             nextmode = GetRecipeToCook(keypad);
288             valid_key = FALSE;                  /* don't beep, special case */
289           }
290           break;
291
292         case PROG_MODE:
293           {
294             program_mode = ENTER_RECIPE_MODE;
295             nextmode = PROGRAMMING_MODE;
296           }
297           break;
298
299         case SAVE:
300           {
301             Display(CLEAR);
302
303             PrintStr("  CREATING Recipe   ");
304             PrintStr("From Last TIME ENTRY");
```

```
305             Beep(750,tone);
306             DelayMilliSecs(    );
307
308             valid_key = FALSE;
309
310             program_mode = PROG_ON_THE_FLY_MODE;
311             nextmode = SELECT_RECIPE_MODE;
312           }
313           break;
314
315
316         case SERVICE:       nextmode = SERVICE_MODE;                    break;
317         case DEMO:          nextmode = DEMO_START_MODE;                 break;
318
319         case START:
320           {
321             if ( default_time < 0 || default_time > 10 )    /* trap for bad values */
322               {
323                 default_time = 4;
324               }
325
326             if ( default_time == 0 )
327               {
328                 cook_time = 30;
329               }
330
331             else
332               {
333                 cook_time = default_time * 100;
334               }
335
336             nextmode = TIME_ENTRY_MODE;
337           }
338           break;
339
340         case T_ENTRY:
341           {
342             cook_time = 0;
343             nextmode = TIME_ENTRY_MODE;
344           }
345           break;
346
347         case MENU:
348           {
349             if ( ++menu > 'C' )
350               {
351                 menu = 'A';
352               }
353           }
354           break;
355
356         case RESET:                                                     break;
357
358         default:            valid_key = FALSE;                          break;
359       }
360
361       if ( valid_key )
362        {
363          Beep(150,tone);                        /* beep if valid key was pressed */
364          ResetCounters();
365        }
366
367       return(nextmode);
368
369     }       /* end Standby */
370
371
372   /*****************************************************************************************************
373   **      TimeEntry MODE                    User is entering in cook time and power levels                **
374   *****************************************************************************************************/
375   int TimeEntry(int keypad)
376     {
377       int           nextmode = TIME_ENTRY_MODE;
378       char          valid_key = TRUE;              /* determines whether or not to beep */
379       static char   field = TIME_FLD;              /* specifies active field */
380       char          door_closed;
```

```
381
382     door_closed = *P6_DR & [illegible];                    /* check to see if [illegible] or is open */
383
384     if (mode_ctr == 0L)                                    /* time entry 1st started */
385       {
386         GetLineFreq();                                     /* determine line frequency 1st!!, mods 'service_code' */
387
388         if ( service_code == NO_ERROR_CODE )
389           {
390             CheckModel();                                  /* check oven model number, modifies 'service_code' */
391           }
392
393         if ( service_code == NO_ERROR_CODE )
394           {
395             CheckVoltage();                                /* check incoming line voltage, modifies 'service_code' */
396           }
397
398         if ( service_code != 0 )
399           {
400             nextmode = SERVICE_CODE_MODE;
401           }
402
403         else
404           {
405             field = TIME_FLD;
406             pwr_level[CENTER] = 10;                        /* initialize to 100% */
407             pwr_level[OUTER] = 10;
408             prev_pwr_level[CENTER] = 10;
409             prev_pwr_level[OUTER] = 10;
410
411             if (model == 203 || model == 243)              /* intialize bottom power for 30 amp models */
412               {
413                 pwr_level[BOTTOM] = 0;
414                 prev_pwr_level[BOTTOM] = 0;
415               }
416
417             else                                           /* initialize bottom power for 50 amp models */
418               {
419                 pwr_level[BOTTOM] = 10;
420                 prev_pwr_level[BOTTOM] = 10;
421               }
422
423             PosString(0, "C:   % O:   % B:   %");
424             PosString(20,"            *READY* ");
425
426             DisplayStage(-1, pwr_level[CENTER], pwr_level[OUTER], pwr_level[BOTTOM], cook_time, 100);
427             Position(25);
428             CursorType(BLINKING);
429           }
430       }
431
432     switch(keypad)
433       {
434         case PAD_0:
435         case PAD_1:
436         case PAD_2:
437         case PAD_3:
438         case PAD_4:
439         case PAD_5:
440         case PAD_6:
441         case PAD_7:
442         case PAD_8:
443         case PAD_9:
444           {
445             if ( field == TIME_FLD )
446               {
447                 cook_time = (10 * cook_time) + NumPadtoNum(keypad);
448
449                 if (cook_time >= 2000)
450                   {
451                     cook_time %= 1000;
452                   }
453               }
454           }                                                /* no break */
455
456         case FULL_POWER:
```

```
457          {
458            if ( keypad == L_POWER && field == TIME_FLD )
459              {
460                valid_key = FALSE;                /* don't beep for time entry field */
461              }
462
463            switch(field)
464              {
465                case CENTER_FLD:    pwr_level[CENTER] = NumPadtoNum(keypad);      break;
466                case OUTER_FLD:     pwr_level[OUTER] = NumPadtoNum(keypad);       break;
467                case BOTTOM_FLD:    pwr_level[BOTTOM] = NumPadtoNum(keypad);      break;
468              }
469
470            if ( model == 203 || model == 243 )   /* 30 amp model exceptions */
471              {
472                if ( field == CENTER_FLD || field == OUTER_FLD )
473                  {
474                    prev_pwr_level[CENTER] = pwr_level[CENTER];
475                    prev_pwr_level[OUTER] = pwr_level[OUTER];
476
477                    if ( pwr_level[CENTER] != 0 || pwr_level[OUTER] != 0 )
478                      {
479                        pwr_level[BOTTOM] = 0;
480                      }
481
482                    else
483                      {
484                        pwr_level[BOTTOM] = prev_pwr_level[BOTTOM];
485                      }
486                  }
487
488                else
489                  {
490                    prev_pwr_level[BOTTOM] = pwr_level[BOTTOM];
491
492                    if ( pwr_level[BOTTOM] == 0)
493                      {
494                        pwr_level[CENTER] = prev_pwr_level[CENTER];
495                        pwr_level[OUTER] = prev_pwr_level[OUTER];
496                      }
497
498                    else
499                      {
500                        pwr_level[CENTER] = 0;
501                        pwr_level[OUTER] = 0;
502                      }
503                  }
504              }                                    /* end of 30 amp model exceptions */
505
506          }
507          break;
508
509        case SLEW_LEFT:
510          {
511            if ( --field < TIME_FLD )
512              {
513                field = BOTTOM_FLD;
514              }
515          }
516          break;
517
518        case SLEW_RIGHT:
519          {
520            if ( ++field > BOTTOM_FLD )
521              {
522                field = TIME_FLD;
523              }
524          }
525          break;
526
527        case START:
528          {
529            if ( door_closed && cook_time > 0)    /* goto cooking mode */
530              {
531                CursorType(NO_LIGHTING);
532
```

```
533                 prev_pwr_le    [CENTER] = pwr_level[CENTER];
534                 prev_pwr_l(    [OUTER] = pwr_level[OUTER];
535                 prev_pwr_lev..[BOTTOM] = pwr_level[BOTTOM];
536
537                 PosString(26,"    *COOKING* ");
538                 Position(0);
539
540                 *IER = 0x01;                        /* enable IRQ0 (zero-cross) */
541                 synced_atod_sampling = TRUE;        /* for taking current and voltage measurements */
542
543                 seconds = 0;                        /* reset line frequency based seconds counters */
544                 seconds_old = 0;
545                 ticks = 0;
546
547                 cook_time = ((cook_time/100) * 60) + (cook_time%100);   /* convert to seconds  */
548
549                 run_time = 0;                       /* reset run time and stage entry for recipe dev. */
550                 stage_entry = 1;
551
552                 start_temp = ReadTemp();            /* get the starting oven temp for Accu-Time */
553
554                 temp_recipe.stage[0].time = 0;
555                 temp_recipe.stage[0].center = pwr_level[CENTER];
556                 temp_recipe.stage[0].outer = pwr_level[OUTER];
557                 temp_recipe.stage[0].bottom = pwr_level[BOTTOM];
558
559                 nextmode = MANUAL_COOKING_MODE;
560               }
561
562             else if ( !door_closed || cook_time <= 0)      /* display why cooking not starting */
563               {
564                 Beep(1000,tone);
565                 valid_key = FALSE;
566                 CursorType(NO_LIGHTING);
567
568                   if ( !door_closed )
569                     {
570                       PosString(26,"  *DOOR OPEN* ");
571                     }
572
573                   else
574                     {
575                       PosString(26,"   ENTER TIME ");
576                     }
577
578                 DelayMilliSecs(2250);
579                 PosString(26,"      *READY* ");
580
581                 field = TIME_FLD;                  /* place cursor in time position */
582
583                 Position(TE_TIME_POS);
584                 CursorType(BLINKING);
585               }
586           }
587           break;
588
589         case RESET:
590           {
591             CursorType(NO_LIGHTING);
592             Display(CLEAR);
593             nextmode = STANDBY_MODE;
594
595             pwr_level[CENTER] = 0;
596             pwr_level[OUTER] = 0;
597             pwr_level[BOTTOM] = 0;
598           }
599           break;
600
601         default:              valid_key = FALSE;              break;
602
603       }          /* end of keypad switch */
604
605
606 /********************************* if still time entry mode then update display *************************/
607
608     if  ( valid_key == TRUE && nextmode == TIME_ENTRY_MODE )
```

```
609        {
610          CursorType(NO_LIGHT    ;
611          DisplayStage(-1, pwr_level[CENTER], pwr_level[OUTER], pwr_level[BOTTOM], cook_time, 100);
612
613          switch(field)
614            {
615              case TIME_FLD:          Position(TE_TIME_POS);      break;
616              case CENTER_FLD:        Position(TE_CTR_POS);       break;
617              case OUTER_FLD:         Position(TE_OTR_POS);       break;
618              case BOTTOM_FLD:        Position(TE_BTM_POS);       break;
619            }
620
621          CursorType(BLINKING);                    /* put cursor back to blinking */
622        }
623
624      if ( valid_key )
625        {
626          Beep(150,tone);                          /* beep for valid keypad input */
627        }
628
629      else
630        {
631          mode_ctr++;                              /* increment timer for mode time out */
632        }
633
634      if ( mode_ctr >= LONG_TIME_OUT )             /* mode time out (10 min.) */
635        {
636          nextmode = STANDBY_MODE;
637
638          CursorType(NO_LIGHTING);
639
640          pwr_level[CENTER] = 0;
641          pwr_level[OUTER] = 0;
642          pwr_level[BOTTOM] = 0;
643        }
644
645      if ( nextmode != TIME_ENTRY_MODE )
646        {
647          ResetCounters();
648
649          if ( nextmode == MANUAL_COOKING_MODE )
650            {
651              switch(field)                        /* used to initialize field to current position */
652                {
653                  case TIME_FLD:
654                  case CENTER_FLD:        mode_ctr = -2L;          break;
655                  case OUTER_FLD:         mode_ctr = -3L;          break;
656                  case BOTTOM_FLD:        mode_ctr = -4L;          break;
657                }
658            }
659        }
660
661      return(nextmode);
662
663    }        /* end TimeEntry */
664
665
666  /*****************************************************************************************************
667  **      ManualCooking MODE                The oven is cooking food in this mode with the                **
668  **                                        lamp power and cook time adjusted by the user                 **
669  **                                        this routine stores all the user's inputs to be               **
670  **                                        saved later for "Cook on the Fly" recipe development          **
671  *****************************************************************************************************/
672  int  ManualCooking(int keypad)
673    {
674      int           nextmode = MANUAL_COOKING_MODE;
675      char          valid_key = TRUE;                /* determines whether or not to beep for key input */
676      char          door_closed;
677      static char   field = CENTER_FLD;              /* specifies active field */
678      static char   relay_switch = 0;                /* flag to toggle bottom relay during power changes */
679
680      door_closed = *P6_DR & 0x02;                   /* check to see if door is open while cooking */
681      mode_ctr++;                                    /* increment mode counter -- very important -- */
682
683
684      if ( mode_ctr <= 0L )
```

```
685        {
686          RELAY1_ON();                                  /* turn on relay .    - initial manual cooking */
687
688          switch(mode_ctr)                              /* initialize field to previous position */
689            {
690              case -1:    field = CENTER_FLD;     mode_ctr = 1L;          break;
691              case -2:    field = OUTER_FLD;      mode_ctr = 1L;          break;
692              case -3:    field = BOTTOM_FLD;     mode_ctr = 1L;          break;
693
694              default:                            mode_ctr = 1L;          break;
695            }
696        }
697
698  /********* used for delaying inputs, power level & relay 2 state changes and initial power on *************/
699
700      switch ( mode_ctr )
701        {
702          case 1:                                       /* load temps on initial start and power changes only! */
703            {
704              temp_pwr_level[CENTER] = pwr_level[CENTER];
705              temp_pwr_level[OUTER] = pwr_level[OUTER];
706              temp_pwr_level[BOTTOM] = pwr_level[BOTTOM];
707            }
708            break;
709
710          case 3:                                       /* toggle relay 2 if needed */
711            {
712              if ( model == 203 || model == 243 )
713                {
714                  if ( pwr_level[BOTTOM] != 0 )
715                    {
716                      relay_switch = 1;
717                    }
718
719                  else
720                    {
721                      relay_switch = -1;
722                    }
723                }
724            }
725            break;
726
727          case 75:                                      /* delayed switching of bottom relay */
728            {
729              if ( relay_switch == 1 )
730                {
731                  RELAY2_ON();                          /* turn on bottom relay */
732                  relay_switch = -1;
733                }
734
735              else
736                {
737                  RELAY2_OFF();                         /* turn on bottom relay */
738                  relay_switch = -1;
739                }
740            }
741            break;
742
743          case 90:                                      /* delay turn on of lamps or change */
744            {
745
746  /****************** Turn on Outer lamp bank to 40% when bottom is on, 30 Amp Models Only *****************/
747
748              if ((model == 203 || model == 243) && pwr_level[BOTTOM] != 0)
749                {
750                  Lamps(pwr_level[CENTER], 4, pwr_level[BOTTOM]);
751                }
752
753              else
754                {
755                  Lamps(pwr_level[CENTER], pwr_level[OUTER], pwr_level[BOTTOM]);
756                }
757            }
758            break;
759
760      }                /* end of mode counter switch */
```

```
761
762 /*************************   ***********************************   ***********************************/
763
764     if ( seconds_old != seconds )                    /* update time if a second has passed */
765       {
766         seconds_old = seconds;                       /* see IRQS.C for line frequency time base routine */
767         cook_time--;
768         run_time++;
769         thirty_min_ctr++;
770
771         CheckWatts();                                /* check to see if lamps are out */
772
773         if ( service_code != NO_ERROR_CODE )
774           {
775             Lamps(0,0,0);                            /* shut off all lamps */
776             ResetCounters();
777             synced_atod_sampling = FALSE;
778             RELAY1_OFF();
779             RELAY2_OFF();
780
781             *IER = 0x00;                             /* disable IRQ0 (zero-cross) */
782
783             nextmode == SERVICE_CODE_MODE;
784           }
785
786         if ( thirty_min_ctr > 1800 )                 /* flag clean oven message after 30 min. run */
787           {
788             clean_oven = TRUE;
789             thirty_min_ctr = 0;                      /* reset counter */
790           }
791
792         Position(20);
793         CursorType(NO_LIGHTING);
794         PrintTime(cook_time,60);
795
796         if ( cook_time == 20 || cook_time == 19 || cook_time == 10 )
797           {
798             Beep(750,tone);
799             PosString(26,"    ADD TIME? ");
800           }
801
802         else if ( cook_time >= 21 )
803           {
804             PosString(26,"    *COOKING* ");
805           }
806
807         switch(field)
808           {
809             case CENTER_FLD:        Position(TE_CTR_POS);        break;
810             case OUTER_FLD:         Position(TE_OTR_POS);        break;
811             case BOTTOM_FLD:        Position(TE_BTM_POS);        break;
812           }
813
814         CursorType(BLINKING);
815       }
816
817     switch(keypad)
818       {
819         case PAD_0:
820         case PAD_1:
821         case PAD_2:
822         case PAD_3:
823         case PAD_4:
824         case PAD_5:
825         case PAD_6:
826         case PAD_7:
827         case PAD_8:
828         case PAD_9:
829         case FULL_POWER:
830           {
831             if ( mode_ctr > 200L )                   /* delays power inputs changes */
832               {
833                 switch(field)
834                   {
835                     case CENTER_FLD:    pwr_level[CENTER] = NumPadtoNum(keypad);      break;
836                     case OUTER_FLD:     pwr_level[OUTER] = NumPadtoNum(keypad);       break;
```

```
                case BOTTOM_FLD:    pwr_level[BOTTOM] = NumPadtoNum(keypad);      break;
              }
          }

        if ( model == 203 || model == 243 )   /* 30 amp model exceptions */
          {
            if ( field == CENTER_FLD || field == OUTER_FLD )
              {
                temp_pwr_level[CENTER] = pwr_level[CENTER];
                temp_pwr_level[OUTER] = pwr_level[OUTER];

                if ( pwr_level[CENTER] != 0 || pwr_level[OUTER] != 0 )
                  {
                    pwr_level[BOTTOM] = 0;
                  }

                else
                  {
                    pwr_level[BOTTOM] = temp_pwr_level[BOTTOM];
                  }
              }

            else
              {
                temp_pwr_level[BOTTOM] = pwr_level[BOTTOM];

                if ( pwr_level[BOTTOM] == 0)
                  {
                    pwr_level[CENTER] = temp_pwr_level[CENTER];
                    pwr_level[OUTER] = temp_pwr_level[OUTER];
                  }

                else
                  {
                    pwr_level[CENTER] = 0;
                    pwr_level[OUTER] = 0;
                  }
              }
          }                        /* end of 30 amp model exceptions */

/************************ update lamp output if needed and save change to memory ************************/

        if ( prev_pwr_level[CENTER] != pwr_level[CENTER] ||
                prev_pwr_level[OUTER] != pwr_level[OUTER] ||
                    prev_pwr_level[BOTTOM] != pwr_level[BOTTOM] )
          {
            if ( model == 203 || model == 243 )
              {
                if ( prev_pwr_level[CENTER] == 0 && prev_pwr_level[OUTER] == 0 &&
                      ( pwr_level[CENTER] != 0 || pwr_level[OUTER] !=0 ))
                  {
                    Lamps(0,0,0);              /* turn all lamps off switch relays later */
                    relay_switch = 0;
                  }

                else if ( prev_pwr_level[BOTTOM] == 0 && pwr_level[BOTTOM] != 0 )
                  {
                    Lamps(0,0,0);              /* turn all lamps off */
                    relay_switch = 1;
                  }

                else
                  {
                    relay_switch = -1;         /* flag not to switch relays */
                  }
              }

            temp_recipe.stage[stage_entry].time = run_time;
            temp_recipe.stage[stage_entry].center = pwr_level[CENTER];
            temp_recipe.stage[stage_entry].outer = pwr_level[OUTER];
            temp_recipe.stage[stage_entry].bottom = pwr_level[BOTTOM];

            if ( stage_entry >= 24 )
              {
                stage_entry = 24;
              }
```

```
913
914                 else
915                   {
916                     stage_entry++;                  /* increment the stage */
917                   }
918
919                 prev_pwr_level[CENTER] = pwr_level[CENTER];
920                 prev_pwr_level[OUTER] = pwr_level[OUTER];
921                 prev_pwr_level[BOTTOM] = pwr_level[BOTTOM];
922
923                 mode_ctr = 2L;                      /* delays power level changes */
924               }
925
926             else
927               {
928                 valid_key = FALSE;                  /* don't beep when delaying keypad input */
929               }
930           }
931           break;
932
933         case ADD_TIME:
934           {
935             if ( add_time < 0 || add_time > 5 )     /* trap for bad values */
936               {
937                 add_time = 1;
938               }
939
940             cook_time += ((add_time + 1) * 10);
941
942             if (cook_time >= 1200)                  /* time limit is 20 min. in seconds */
943               {
944                 cook_time = 1200;
945               }
946           }
947           break;
948
949         case SLEW_LEFT:
950           {
951             if ( --field < CENTER_FLD )
952               {
953                 field = BOTTOM_FLD;
954                 Position(field);
955               }
956           }
957           break;
958
959         case SLEW_RIGHT:
960           {
961             if ( ++field > BOTTOM_FLD )
962               {
963                 field = CENTER_FLD;
964                 Position(field);
965               }
966           }
967           break;
968
969         case RESET:         nextmode = PAUSE_MODE;                    break;
970         default:            valid_key = FALSE;                        break;
971
972       }                             /* end fo keypad input switch */
973
974     if ( valid_key )
975       {
976         CursorType(NO_LIGHTING);
977         DisplayStage(-1, pwr_level[CENTER], pwr_level[OUTER], pwr_level[BOTTOM], cook_time, 60);
978
979         switch(field)
980           {
981             case CENTER_FLD:        Position(TE_CTR_POS);       break;
982             case OUTER_FLD:         Position(TE_OTR_POS);       break;
983             case BOTTOM_FLD:        Position(TE_BTM_POS);       break;
984           }
985
986         CursorType(BLINKING);
987
988         Beep(150,tone);                             /* beep if valid key was pressed */
```

```
989        }
990
991       if ( !door_closed || cook_time <= 0)
992        {
993          nextmode = PAUSE_MODE;
994        }
995
996       if ( nextmode == PAUSE_MODE )
997        {
998          Lamps(0,0,0);                          /* shut of all lamps */
999          ResetCounters();
1000         mode_ctr = -1L;
1001
1002         *IER = 0x00;                           /* disable IRQ0 (zero-cross) */
1003         CursorType(NO_LIGHTING);
1004
1005         if ( cook_time <= 0 )
1006           {
1007             prev_cooking_mode = CONT_TIME_ENTRY_COOK;   /* flag for continue mode */
1008             Beep(1500,tone);
1009             message = 3;                       /* display "DONE" meassage      */
1010           }
1011
1012         else
1013           {
1014             prev_cooking_mode = PAUSE_TIME_ENTRY_COOK;  /* flag for pause mode    */
1015             Beep(500,tone);
1016             message = 4;                       /* display "PAUSED" meassage    */
1017           }
1018       }
1019
1020      return(nextmode);
1021
1022   }       /* end ManualCooking */
1023
1024
1025 /*****************************************************************************************************
1026 **      RecipeCooking MODE                 The oven is cooking food in this mode by retrieving          **
1027 **                                         the recipe previously stored in EEprom                       **
1028 *****************************************************************************************************/
1029 int  RecipeCooking(int keypad)
1030   {
1031     int            nextmode = RECIPE_COOKING_MODE;
1032     char           valid_key = TRUE;          /* determines whether or not to beep for key input */
1033     char           door_closed;
1034     static char    delay = FALSE;
1035     static char    relay_switch = 0;          /* flag to toggle relay during power changes */
1036     static int     beep_time = 0;
1037
1038     door_closed = *P6_DR & 0x02;              /* check to see if door is open while cooking */
1039     mode_ctr++;                               /* increment mode counter -- very important -- */
1040
1041     if ( mode_ctr < 0L )
1042       {
1043         mode_ctr = 1;                         /* to skip mode_ctr = 0 switch */
1044         delay = FALSE;
1045         RELAY1_ON();
1046       }
1047
1048 /********* used for delaying inputs, power level & relay 2 state changes and initial power on *************/
1049
1050     switch ( mode_ctr )
1051       {
1052         case 0:                               /* catch's delayed turn on for power change */
1053           {
1054             delay = TRUE;
1055           }
1056           break;
1057
1058         case 3:                               /* toggle relay 2 if needed */
1059           {
1060             if ( model == 203 || model == 243 )
1061               {
1062                 if ( recipe.stage[stage_entry + delay].bottom != 0 )
1063                   {
1064                     relay_switch = 1;         /* turn on relay 2 later */
```

```
1065                  }
1066
1067                else
1068                  {
1069                    relay_switch = -1;
1070                  }
1071              }
1072          }
1073          break;
1074
1075        case 75:                                  /* delayed switching of bottom relay */
1076          {
1077            if ( relay_switch == 1 )
1078              {
1079                RELAY2_ON();                      /* turn on bottom relay */
1080                relay_switch = -1;
1081              }
1082
1083            else
1084              {
1085                RELAY2_OFF();                     /* turn on bottom relay */
1086                relay_switch = -1;
1087              }
1088          }
1089          break;
1090
1091        case 90:                                  /* delay turn on of lamps or change */
1092          {
1093            if ( delay == TRUE )
1094              {
1095                stage_entry++;
1096                delay = FALSE;
1097              }
1098
1099 /****************** Turn on Outer lamp bank to 40% when bottom is on, 30 Amp Models Only ******************/
1100
1101            if ((model == 203 || model == 243) && recipe.stage[stage_entry].bottom != 0)
1102              {
1103                Lamps(recipe.stage[stage_entry].center, 4, recipe.stage[stage_entry].bottom);
1104              }
1105
1106            else
1107              {
1108                Lamps(recipe.stage[stage_entry].center, recipe.stage[stage_entry].outer,
1109                                                        recipe.stage[stage_entry].bottom);
1110              }
1111
1112            prev_pwr_level[CENTER] = recipe.stage[stage_entry].center;
1113            prev_pwr_level[OUTER] = recipe.stage[stage_entry].outer;
1114            prev_pwr_level[BOTTOM] = recipe.stage[stage_entry].bottom;
1115
1116          }
1117          break;
1118
1119      }                /* end of mode counter switch */
1120
1121    if ( run_time == recipe.stage[stage_entry+1].time && run_time != 0 )
1122      {
1123        if ( recipe.stage[stage_entry+1].time < header.cook_time )
1124          {
1125            if ( model == 203 || model == 243 )
1126              {
1127                if ((recipe.stage[stage_entry+1].center != 0 ||
1128                       recipe.stage[stage_entry+1].outer != 0) &&
1129                         prev_pwr_level[CENTER] == 0 && prev_pwr_level[OUTER] == 0 &&
1130                                                          prev_pwr_level[BOTTOM] != 0)
1131                  {
1132                    Lamps(0,0,0);                 /* turn off all lamps */
1133                    relay_switch = -1;
1134                    mode_ctr = -1L;               /* delay lamp turn on */
1135                  }
1136
1137                else if ( recipe.stage[stage_entry+1].bottom != 0 &&
1138                          (prev_pwr_level[CENTER] !=0 || prev_pwr_level[OUTER] !=0) &&
1139                                (recipe.stage[stage_entry+1].center == 0 ||
1140                                       recipe.stage[stage_entry+1].outer == 0))
```

```
1141                    {
1142                      Lamps(0,    ;                    /* turn off all la    */
1143                      relay_switch = 1;
1144                      mode_ctr = -1L;                  /* delay lamp turn on */
1145                    }
1146                }
1147
1148              if ( mode_ctr >= 0L )                    /* no delayed turn on */
1149                {
1150                  stage_entry++;
1151
1152                  Lamps(recipe.stage[stage_entry].center, recipe.stage[stage_entry].outer,
1153                                                    recipe.stage[stage_entry].bottom);
1154
1155                  prev_pwr_level[CENTER] = recipe.stage[stage_entry].center;
1156                  prev_pwr_level[OUTER] = recipe.stage[stage_entry].outer;
1157                  prev_pwr_level[BOTTOM] = recipe.stage[stage_entry].bottom;
1158                }
1159            }
1160        }
1161
1162      if ( seconds_old != seconds )                    /* update time if a second has passed */
1163        {
1164          seconds_old = seconds;                       /* see IRQS.C for line frequency time base routine */
1165          cook_time--;
1166          run_time++;
1167          thirty_min_ctr++;
1168
1169          CheckWatts();                                /* check to see if lamps are out */
1170
1171          if ( service_code != NO_ERROR_CODE )
1172            {
1173              Lamps(0,0,0);                            /* shut off all lamps */
1174              ResetCounters();
1175              synced_atod_sampling = FALSE;
1176              RELAY1_OFF();
1177              RELAY2_OFF();
1178
1179              *IER = 0x00;                             /* disable IRQ0 (zero-cross) */
1180
1181              nextmode == SERVICE_CODE_MODE;
1182            }
1183
1184          if ( thirty_min_ctr > 1800 )                 /* flag clean oven message after 30 min. run */
1185            {
1186              clean_oven = TRUE;
1187              thirty_min_ctr = 0;                      /* reset counter */
1188            }
1189
1190          Position(20);
1191          PrintTime(cook_time,60);
1192        }
1193
1194      if ( cook_time == 20 || cook_time == 19 || cook_time == 10 )
1195        {
1196          if ( beep_time != cook_time )
1197            {
1198              Beep(750,tone);
1199              PosString(27,"   ADD TIME? ");
1200            }
1201
1202          beep_time = cook_time;
1203        }
1204
1205      else if ( cook_time >= 21 )
1206        {
1207          PosString(27,"   *COOKING* ");
1208          beep_time = 0;
1209        }
1210
1211      switch(keypad)
1212        {
1213          case ADD_TIME:
1214            {
1215              cook_time += ((add_time + 1) * 10);
1216
```

```
1217            Position(20);
1218            PrintTime(cook_t    60);
1219
1220            if (cook_time >= 1200)                /* time limit is 20 min. in seconds */
1221              {
1222                cook_time = 1200;
1223              }
1224          }
1225          break;
1226
1227        case RESET:         nextmode = PAUSE_MODE;                    break;
1228
1229        default:            valid_key = FALSE;                        break;
1230
1231      }                                           /* end fo keypad input switch */
1232
1233    if ( valid_key )
1234      {
1235        Beep(150,tone);                           /* beep if valid key was pressed */
1236      }
1237
1238    if ( !door_closed || cook_time <= 0 || nextmode == PAUSE_MODE )
1239      {
1240        Lamps(0,0,0);                             /* shut off all lamps */
1241        ResetCounters();
1242        nextmode = PAUSE_MODE;
1243        prev_cooking_mode = PAUSE_RECIPE_COOK;
1244
1245        *IER = 0x00;                              /* disable IRQ0 (zero-cross) */
1246
1247        if ( cook_time <= 0 )
1248          {
1249            Beep(1500,tone);                      /* "*DONE*" message */
1250            message = 3;
1251            CursorType(NO_LIGHTING);
1252          }
1253
1254        else
1255          {
1256            Beep(500,tone);
1257            message = 4;                          /* "*PAUSED*" message " */
1258            CursorType(NO_LIGHTING);
1259          }
1260      }
1261
1262    return(nextmode);
1263
1264  }       /* end RecipeCooking */
1265
1266
1267 /*****************************************************************************************************
1268 **      Pause MODE                      The oven in pasue mode, waiting for start pad press          **
1269 **                                      or will time out                                             **
1270 **                                                                                                   **
1271 **                                      mode will allow user to continue if timed entry cooking &    **
1272 **                                      if time ran out.  user enters time and presses start         **
1273 **                                      to continue cooking                                          **
1274 *****************************************************************************************************/
1275 int  Pause(int keypad)
1276  {
1277    int           nextmode = PAUSE_MODE;
1278    char          valid_key = TRUE;               /* determines whether or not to beep for key input   */
1279    char          door_closed;
1280    static int    saving = FALSE;                 /* flag for going into select recipe mode            */
1281    static char   relay2_state = FALSE;           /* for saving state of relay before going into pause */
1282    static char   opened = FALSE;                 /* keeps track if door has been detected opened      */
1283
1284    door_closed = *P6_DR & 0x02;                  /* check to see if door is open */
1285
1286    if ( mode_ctr == 0L )
1287      {
1288        message_ctr = mode_ctr;
1289        CursorType(NO_LIGHTING);
1290        relay2_state = *P9_DR & 0x01;
1291        opened = FALSE;
1292      }
```

```
1293
1294    if ( !door_closed && !o    d )
1295      {
1296        opened = TRUE;
1297
1298        RELAY1_OFF();
1299        RELAY2_OFF();
1300      }
1301
1302    if ( mode_ctr == message_ctr )                /* display message */
1303      {
1304        message_ctr = mode_ctr + 300L;
1305        CursorType(NO_LIGHTING);
1306
1307        switch ( message )
1308          {
1309            case 0:   PosString(26,"  ENTER TIME  ");   message = 1;      break;
1310            case 1:   PosString(26,"  To CONTINUE ");   message = 0;      break;
1311
1312            case 2:
1313              {
1314                PosString(27," *DOOR OPEN* ");
1315
1316                if ( prev_cooking_mode == CONT_TIME_ENTRY_COOK )
1317                  {
1318                    message = 0;                  /* display "ENTER TIME" message next */
1319                  }
1320
1321                else
1322                  {
1323                    message = 4;                  /* display "PAUSED" message next */
1324                  }
1325              }
1326              break;
1327
1328            case 3:
1329              {
1330                PosString(27,"     *DONE*   ");
1331
1332                if ( prev_cooking_mode == PAUSE_RECIPE_COOK )
1333                  {
1334                    saving = FALSE;
1335                    mode_ctr = -300L;             /* set exit point for STANDBY_MODE */
1336                  }
1337
1338                else
1339                  {
1340                    message = 0;
1341                  }
1342              }
1343              break;
1344
1345            case 4:   PosString(27,"    *PAUSED* ");    message = 4;      break;
1346          }
1347
1348        if ( message == 0 || message == 1 )
1349          {
1350            Position(TE_TIME_POS);                /* position cursor for time entry */
1351            CursorType(BLINKING);
1352          }
1353      }
1354
1355    mode_ctr++;                                   /********* increment counter here !!!! *******/
1356
1357    switch(keypad)
1358      {
1359        case PAD_0:                               /* time entry for continue mode */
1360        case PAD_1:
1361        case PAD_2:
1362        case PAD_3:
1363        case PAD_4:
1364        case PAD_5:
1365        case PAD_6:
1366        case PAD_7:
1367        case PAD_8:
1368        case PAD_9:
```

```
1369          {
1370            if ( prev_cooking_mode == CONT_TIME_ENTRY_COOK )
1371              {
1372                cook_time = (10 * cook_time) + NumPadtoNum(keypad);
1373
1374                if (cook_time >= 2000)
1375                  {
1376                    cook_time %= 1000;
1377                  }
1378
1379                CursorType(NO_LIGHTING);
1380                Position(20);
1381                PrintTime(cook_time, 100);
1382                Position(TE_TIME_POS);
1383                CursorType(BLINKING);
1384              }
1385          }
1386          break;
1387
1388
1389        case SAVE:
1390          {
1391            if ( prev_cooking_mode == PAUSE_RECIPE_COOK )
1392              {
1393                valid_key = FALSE;
1394              }
1395
1396            else                                /* opening display shown in select recipe mode */
1397              {
1398                program_mode = PROG_ON_THE_FLY_MODE;
1399
1400                Display(CLEAR);
1401                CursorType(NO_LIGHTING);
1402
1403                PrintStr("  CREATING Recipe   ");
1404                PrintStr("From Last TIME ENTRY");
1405                Beep(750,tone);
1406
1407                valid_key = FALSE;
1408
1409                saving = TRUE;
1410                mode_ctr = -200L;               /* set exit point for SELECT_RECIPE_MODE */
1411              }
1412          }
1413          break;
1414
1415        case START:
1416          {
1417            if ( mode_ctr > 50L )               /* delay a start after going into pause */
1418              {
1419                if ( door_closed && cook_time > 0)    /* goto cooking mode */
1420                  {
1421                    prev_pwr_level[CENTER] = pwr_level[CENTER];
1422                    prev_pwr_level[OUTER] = pwr_level[OUTER];
1423                    prev_pwr_level[BOTTOM] = pwr_level[BOTTOM];
1424
1425                    *IER = 0x01;                /* enable IRQ0 (zero-cross) */
1426                    seconds = 0;                /* reset line frequency based seconds counter */
1427                    seconds_old = 0;
1428                    ticks = 0;
1429
1430                    RELAY1_ON();
1431                    mode_ctr = -550L;           /* to delay Relay 2 start up */
1432
1433                    PosString(27,"   *COOKING* ");
1434                    Position(0);
1435                  }
1436
1437                else
1438                  {
1439                    Beep(1000,tone);
1440                    valid_key = FALSE;
1441
1442                    message_ctr = mode_ctr;
1443
1444                    if ( !door_closed )         /* display door is open */
```

```
1445                    {
1446                      mes.    = 2;
1447                    }
1448
1449                  else                          /* display enter time */
1450                    {
1451                      message = 0;
1452                    }
1453                }
1454            }
1455
1456          else
1457            {
1458              valid_key = FALSE;
1459            }
1460
1461        }
1462        break;
1463
1464
1465      case RESET:
1466        {
1467          if ( mode_ctr > 50L )                 /* delay reset input after going into pause */
1468            {
1469              saving = FALSE;
1470              mode_ctr = -200L;                 /* set exit point for STANDBY_MODE */
1471            }
1472
1473          else
1474            {
1475              valid_key = FALSE;
1476            }
1477        }
1478        break;
1479
1480      default:            valid_key = FALSE;                    break;
1481    }
1482
1483  if ( valid_key )
1484    {
1485      Beep(150,tone);                           /* beep if valid key was pressed */
1486    }
1487
1488  if ( mode_ctr >= TIMEOUT )                    /* 10 min */
1489    {
1490      saving = FALSE;
1491      mode_ctr = -200L;                         /* set exit point for STANDBY_MODE */
1492    }
1493
1494 /******************* continue cooking from here, make sure relays2 is turned on if needed ***************/
1495
1496  if ( mode_ctr == -400L )
1497    {
1498      ResetCounters();
1499
1500      if ( relay2_state )
1501        {
1502          RELAY2_ON();                          /* turn on relay2 if originally on */
1503        }
1504
1505      if ( prev_cooking_mode == CONT_TIME_ENTRY_COOK )
1506        {
1507          cook_time = ((cook_time/100) * 60) + (cook_time%100);   /* convert to seconds */
1508        }
1509
1510      if ( prev_cooking_mode == PAUSE_RECIPE_COOK )
1511        {
1512          nextmode = RECIPE_COOKING_MODE;
1513        }
1514
1515      else
1516        {
1517          nextmode = MANUAL_COOKING_MODE;
1518          mode_ctr = 1L;                        /* don't load power levels in manual cooking mode */
1519        }
1520    }
```

```
1521
1522 /*************************Exiting point for pause mode & cooking modes ******************************/
1523
1524     if ( mode_ctr == -200L )
1525       {
1526         RELAY2_OFF();
1527       }
1528
1529     if ( mode_ctr == -100L )                        /* delayed shut off of relay 1 */
1530       {
1531         RELAY1_OFF();
1532         synced_atod_sampling = FALSE;               /* disable current and voltage measurements */
1533
1534         if ( prev_cooking_mode == CONT_TIME_ENTRY_COOK ||
1535                                   prev_cooking_mode == PAUSE_TIME_ENTRY_COOK )
1536           {
1537             temp_recipe.stage[stage_entry].time = run_time;
1538             temp_recipe.stage[stage_entry].center = 0;
1539             temp_recipe.stage[stage_entry].outer = 0;
1540             temp_recipe.stage[stage_entry].bottom = 0;
1541
1542             temp_recipe.stage[stage_entry+1].time = -1;    /* end of recipe flag */
1543
1544             OptimizeRecipe();
1545           }
1546
1547         if ( saving )
1548           {
1549             DelayMilliSecs(2000);                   /* time to display message */
1550             nextmode = SELECT_RECIPE_MODE;
1551           }
1552
1553         else
1554           {
1555             Display(CLEAR);
1556             nextmode = STANDBY_MODE;
1557           }
1558
1559         ResetCounters();
1560         return(nextmode);                           /* exit point for saving or standby modes */
1561       }
1562
1563     return(nextmode);                               /* exit point for resuming cooking or cont. pause */
1564
1565   }       /* end Pause */
1566
1567
1568 /*****************************************************************************************************
1569 **      Programming MODE                    The user is programming recipes, user options, etc.          **
1570 *****************************************************************************************************/
1571 int  Programming(int keypad)
1572   {
1573     int           nextmode = PROGRAMMING_MODE;
1574     int           n;
1575     int           ee_error = FALSE;
1576     char          valid_key = TRUE;                 /* determines whether or not to beep for key input */
1577
1578     if ( mode_ctr == message_ctr || mode_ctr == 0L )
1579       {
1580         if ( mode_ctr == 0L )
1581           {
1582             Display(CLEAR);
1583             ee_error += EEReadByte(MODEL_ADDR, (unsigned char *)&model);   /* just checking EEprom */
1584
1585             if ( ee_error )
1586               {
1587                 service_code = MEMORY_ERROR_CODE;
1588                 nextmode = SERVICE_CODE_MODE;
1589               }
1590           }
1591
1592         UserPrompts(nextmode);                      /* display user prompt messages */
1593       }
1594
1595     switch(keypad)
1596       {
```

```
1597        case SLEW_LEFT:
1598          {
1599            if ( --program_mode < ENTER_RECIPE_MODE )
1600              {
1601                program_mode = MODIFY_OPTIONS_MODE;
1602              }
1603          }
1604          break;
1605
1606        case SLEW_RIGHT:
1607          {
1608            if ( ++program_mode > MODIFY_OPTIONS_MODE )
1609              {
1610                program_mode = ENTER_RECIPE_MODE;
1611              }
1612          }
1613          break;
1614
1615        case ENTER:
1616          {
1617            if ( program_mode == MODIFY_OPTIONS_MODE )
1618              {
1619                nextmode = program_mode;
1620              }
1621
1622            else
1623              {
1624                nextmode = SELECT_RECIPE_MODE;
1625              }
1626          }
1627          break;
1628
1629    /*    case PREV:  */
1630        case RESET:          nextmode = STANDBY_MODE;                    break;
1631
1632        default:             valid_key = FALSE;                          break;
1633      }
1634
1635    switch(program_mode)
1636      {
1637        case ENTER_RECIPE_MODE:       PosString(0,"< ENTER/MODIFY REC >");    break;
1638        case DELETE_RECIPE_MODE:      PosString(0,"<  DELETE RECIPE   >");    break;
1639        case MODIFY_OPTIONS_MODE:     PosString(0,"< MODIFY USER OPTS >");    break;
1640      }
1641
1642    if ( valid_key )
1643      {
1644        Beep(150,tone);                          /* beep if valid key was pressed */
1645      }
1646
1647    else
1648      {
1649        mode_ctr++;
1650      }
1651
1652    if ( mode_ctr >= LONG_TIME_OUT )             /* 10 min */
1653      {
1654        nextmode = STANDBY_MODE;
1655      }
1656
1657    if ( nextmode != PROGRAMMING_MODE )
1658      {
1659        Display(CLEAR);
1660        ResetCounters();
1661      }
1662
1663    return(nextmode);
1664
1665  }       /* end Programming */
1666
1667
1668 /*****************************************************************************************************
1669 **      Select Recipe MODE                Select a recipe to program                                **
1670 *****************************************************************************************************/
1671 int  SelectRecipe(int keypad)
1672  {
```

mode=

```
int          nextmo     SELECT_RECIPE_MODE;
char         valid_ke    TRUE;                    /* determines whe  r or not to beep for key input */

if ( mode_ctr == 1L )
  {
    Display(CLEAR);

    switch(program_mode)
      {
        case ENTER_RECIPE_MODE:       PosString(20," To ENTER or MODIFY ");     break;
        case DELETE_RECIPE_MODE:      PosString(20,"     To DELETE      ");     break;
        case PROG_ON_THE_FLY_MODE:    PosString(20,"   For NEW Recipe   ");     break;
      }

    PosString(0," Select RECIPE #:");
    Display(menu);
    CursorType(BLINKING);
  }

switch(keypad)
  {
    case PAD_0:                                   /* recipe number entry */
    case PAD_1:
    case PAD_2:
    case PAD_3:
    case PAD_4:
    case PAD_5:
    case PAD_6:
    case PAD_7:
    case PAD_8:
    case PAD_9:     Beep(150,tone);   nextmode = GetRecipeToProgram(keypad);    break;

    case MENU:
      {
        if ( ++menu > 'C' )
          {
            menu = 'A';
          }
      }
      break;

    case PREV:
      {
        if ( program_mode != PROG_ON_THE_FLY_MODE )
          {
            CursorType(NO_LIGHTING);
            Display(CLEAR);
            nextmode = PROGRAMMING_MODE;
          }

        else
          {
            valid_key = FALSE;
          }
      }
      break;

    case RESET:                   nextmode = STANDBY_MODE;          break;

    default:                      valid_key = FALSE;                break;
  }

if ( valid_key )
  {
    Beep(150,tone);                               /* beep if valid key was pressed */
    mode_ctr = 1L;
  }

else
  {
    mode_ctr++;
  }

if ( mode_ctr >= LONG_TIME_OUT )                  /* 10 min */
  {
```

```
1749          nextmode = STANDBY_J    ';
1750        }
1751
1752      if ( nextmode != SELECT_RECIPE_MODE )
1753        {
1754          Display(CLEAR);
1755          ResetCounters();
1756        }
1757
1758
1759      return(nextmode);
1760
1761    }        /* end SelectRecipe */
1762
1763
1764 /*****************************************************************************************************
1765 **       Select Name MODE                    Select a name for the recipe                          **
1766 *****************************************************************************************************/
1767 int  SelectName(int keypad)
1768   {
1769     int            nextmode = SELECT_NAME_MODE;
1770     char           valid_key = TRUE;                /* determines whether or not to beep for key input */
1771
1772     if ( mode_ctr == message_ctr || mode_ctr == 0L )
1773       {
1774         UserPrompts(nextmode);                      /* display user prompt messages */
1775       }
1776
1777     switch(keypad)
1778       {
1779         case SLEW_RIGHT:
1780           {
1781             if ( ++header.name_num > name_limit )
1782               {
1783                 header.name_num = 0;
1784               }
1785           }
1786           break;
1787
1788         case SLEW_LEFT:
1789           {
1790             if ( --header.name_num < 0 )
1791               {
1792                 header.name_num = name_limit;
1793               }
1794           }
1795           break;
1796
1797         case PREV:          nextmode = SELECT_RECIPE_MODE;          break;
1798         case RESET:         nextmode = STANDBY_MODE;                break;
1799         case ENTER:
1800           {
1801             if ( program_mode == PROG_ON_THE_FLY_MODE )
1802               {
1803                 nextmode = ACCU_TIME_MODE;
1804               }
1805
1806             else
1807               {
1808                 nextmode = STAGE_ENTRY_MODE;
1809               }
1810           }
1811           break;
1812
1813         default:            valid_key = FALSE;                      break;
1814       }
1815
1816     PosString(0,"< ");
1817     PosString(18," >");
1818     PosString(2,recipe_name[header.name_num]);
1819
1820     if ( valid_key )
1821       {
1822         Beep(150,tone);                             /* beep if valid key was pressed */
1823       }
1824
```

```
1825     else
1826       {
1827         mode_ctr++;
1828       }
1829
1830     if ( mode_ctr >= LONG_TIME_OUT )              /* 10 min */
1831       {
1832         nextmode = STANDBY_MODE;
1833       }
1834
1835     if ( nextmode != SELECT_NAME_MODE )
1836       {
1837         Display(CLEAR);
1838         ResetCounters();
1839       }
1840
1841     return(nextmode);
1842
1843   }       /* end SelectName */
1844
1845
1846 /*****************************************************************************************************
1847 **      StageEntry                          Entry in the cook time & lamp powers into upto eight stages     **
1848 *****************************************************************************************************/
1849 int  StageEntry(int keypad)
1850   {
1851     int           nextmode = STAGE_ENTRY_MODE;
1852     int           n, last_stage, tot_cook_time;
1853     char          valid_key = TRUE;               /* determines whether or not to beep for key input */
1854     static int    stage_time[6];                  /* for storing time duration of each stage */
1855     static char   field = STAGE_FLD;
1856
1857     if (mode_ctr == 0L)                           /* time entry, 1st time thru */
1858       {
1859         field = STAGE_FLD;
1860
1861         for ( n = 0; n < 6; n++)
1862           {
1863             stage_time[n] = 0;                    /* clear out all stage times */
1864           }
1865
1866 /************************* calculate stage times and convert to base 10  ********************************/
1867
1868         for ( n = 0; (recipe.stage[n+1].time != -1) && (n < 6); n++ )
1869           {
1870             stage_time[n] = recipe.stage[n+1].time - recipe.stage[n].time;
1871             stage_time[n] =  ((stage_time[n]/60)*100 + (stage_time[n]%60));
1872
1873             if (stage_time[n] < 0)                /* catch any negative numbers */
1874               {
1875                 stage_time[n] = 0;
1876               }
1877           }
1878
1879         if ( stage_num > 6 || stage_num < 1 )
1880           {
1881             stage_num = 1;                        /* catch if old stage number is out of range */
1882           }
1883
1884         prev_pwr_level[CENTER] = recipe.stage[stage_num-1].center;
1885         prev_pwr_level[OUTER] = recipe.stage[stage_num-1].outer;
1886         prev_pwr_level[BOTTOM] = recipe.stage[stage_num-1].bottom;
1887
1888         Display(CLEAR);                           /* display stage entry format */
1889         PrintStr("STAGE");
1890         Display(0xF7);                            /* display special char. "->" */
1891         Position(8);
1892         PrintStr("TIME:");
1893         PosString(20,"C:   % O:   % B:   %");
1894         field = STAGE_FLD;
1895
1896         DisplayStage(stage_num, recipe.stage[stage_num-1].center,
1897                                 recipe.stage[stage_num-1].outer,
1898                                 recipe.stage[stage_num-1].bottom, stage_time[stage_num-1], 100);
1899
1900         Position(ST_NUM_POS);
```

```
1901        CursorType(BLINKING;
1902      }                                          /* end of first t    thru */
1903
1904    switch(keypad)
1905      {
1906        case PAD_0:
1907        case PAD_1:
1908        case PAD_2:
1909        case PAD_3:
1910        case PAD_4:
1911        case PAD_5:
1912        case PAD_6:
1913        case PAD_7:
1914        case PAD_8:
1915        case PAD_9:
1916          {
1917            if ( field == STAGE_FLD && keypad != PAD_0 )
1918              {
1919                stage_num = NumPadtoNum(keypad);
1920
1921                if ( stage_num > 6 )
1922                  {
1923                    stage_num = 6;
1924                  }
1925
1926                prev_pwr_level[CENTER] = recipe.stage[stage_num-1].center;
1927                prev_pwr_level[OUTER] = recipe.stage[stage_num-1].outer;
1928                prev_pwr_level[BOTTOM] = recipe.stage[stage_num-1].bottom;
1929              }
1930
1931            if ( field == TIME_FLD )
1932              {
1933                stage_time[stage_num-1] = (10 * stage_time[stage_num-1]) + NumPadtoNum(keypad);
1934
1935                if (stage_time[stage_num-1] >= 2000)
1936                  {
1937                    stage_time[stage_num-1] %= 1000;
1938                  }
1939              }
1940          }                                      /* no break */
1941
1942        case FULL_POWER:
1943          {
1944            if ( keypad == FULL_POWER && ( field == TIME_FLD || field == STAGE_FLD ))
1945              {
1946                valid_key = FALSE;               /* don't beep for time entry field */
1947              }
1948
1949            switch(field)
1950              {
1951                case CENTER_FLD:  recipe.stage[stage_num-1].center = NumPadtoNum(keypad);   break;
1952                case OUTER_FLD:   recipe.stage[stage_num-1].outer = NumPadtoNum(keypad);    break;
1953                case BOTTOM_FLD:  recipe.stage[stage_num-1].bottom = NumPadtoNum(keypad);   break;
1954              }
1955
1956            if ( model == 203 || model == 243 )   /* 30 amp model exceptions */
1957              {
1958                if ( field == CENTER_FLD || field == OUTER_FLD )
1959                  {
1960                    prev_pwr_level[CENTER] = recipe.stage[stage_num-1].center;
1961                    prev_pwr_level[OUTER] = recipe.stage[stage_num-1].outer;
1962
1963                    if ( recipe.stage[stage_num-1].center != 0 ||
1964                                          recipe.stage[stage_num-1].outer != 0 )
1965                      {
1966                        recipe.stage[stage_num-1].bottom = 0;
1967                      }
1968
1969                    else
1970                      {
1971                        recipe.stage[stage_num-1].bottom = prev_pwr_level[BOTTOM];
1972                      }
1973                  }
1974
1975              else if ( field == BOTTOM_FLD )
1976                {
```

```
                    prev_pwr_level[BOTTOM] = recipe.stage[stage_num-1].bottom;
                    if ( recipe.stage[stage_num-1].bottom == 0)
                      {
                        recipe.stage[stage_num-1].center = prev_pwr_level[CENTER];
                        recipe.stage[stage_num-1].outer = prev_pwr_level[OUTER];
                      }

                    else
                      {
                        recipe.stage[stage_num-1].center = 0;
                        recipe.stage[stage_num-1].outer = 0;
                      }
                  }
              }                                        /* end of 30 amp model exceptions */

          }
          break;

        case SLEW_LEFT:
          {
            if ( --field < STAGE_FLD )
              {
                field = BOTTOM_FLD;
              }
          }
          break;

        case SLEW_RIGHT:
          {
            if ( ++field > BOTTOM_FLD )
              {
                field = STAGE_FLD;
              }
          }
          break;

        case PREV:          nextmode = SELECT_NAME_MODE;        break;
        case ENTER:         nextmode = ACCU_TIME_MODE;          break;

        case RESET:
          {
            CursorType(NO_LIGHTING);
            nextmode = STANDBY_MODE;
          }
          break;

        default:                valid_key = FALSE;              break;

      }          /* end of keypad switch */


/***************************** if still time entry mode then update display ******************************/

    if  ( valid_key == TRUE && nextmode == STAGE_ENTRY_MODE )
      {
        CursorType(NO_LIGHTING);

        DisplayStage(stage_num, recipe.stage[stage_num-1].center,
                                recipe.stage[stage_num-1].outer,
                                recipe.stage[stage_num-1].bottom, stage_time[stage_num-1], 100);

        switch(field)
          {
            case STAGE_FLD:         Position(ST_NUM_POS);       break;
            case TIME_FLD:          Position(ST_TIME_POS);      break;
            case CENTER_FLD:        Position(ST_CTR_POS);       break;
            case OUTER_FLD:         Position(ST_OTR_POS);       break;
            case BOTTOM_FLD:        Position(ST_BTM_POS);       break;
          }

        CursorType(BLINKING);                      /* put cursor back to blinking */
      }

    if ( valid_key )
      {
```

d. key

```
2053          Beep(150,tone);                          /* beep if valid  was pressed */
2054          mode_ctr = 1L;                           /* DO NOT reset counter to ZERO! */
2055        }
2056
2057      else
2058        {
2059          mode_ctr++;
2060        }
2061
2062      if ( mode_ctr > LONG_TIME_OUT )              /* 10 min */
2063        {
2064          nextmode = STANDBY_MODE;
2065        }
2066
2067      if ( nextmode != STAGE_ENTRY_MODE )
2068        {
2069          for ( n = 0, last_stage = 0 ; n < 6; n++)     /* convert to base 60 (seconds) */
2070            {
2071              stage_time[n] =  ((stage_time[n]/100)*60 + (stage_time[n]%100));
2072
2073              if ( stage_time[n] > 0 )             /* determine last non - empty stage */
2074                {
2075                  last_stage = n;
2076                }
2077
2078              else                                 /* clear stages with no cook time */
2079                {
2080                  recipe.stage[n].center = 0;
2081                  recipe.stage[n].outer = 0;
2082                  recipe.stage[n].bottom = 0;
2083                }
2084            }
2085
2086          for ( n = 0, tot_cook_time = 0;  n < (last_stage+2); n++ )
2087            {
2088              recipe.stage[n].time = tot_cook_time;
2089              tot_cook_time += stage_time[n];
2090            }
2091
2092          recipe.stage[last_stage+2].time = -1;     /* set end of recipe flag */
2093
2094          Display(CLEAR);
2095          CursorType(NO_LIGHTING);
2096          ResetCounters();
2097        }
2098
2099      return(nextmode);
2100
2101    }       /* end StageEntry */
2102
2103
2104 /*****************************************************************************************************
2105 **      Recipe Exists MODE                  Prompt user recipe exists at this location                **
2106 **                                          provide choise to continue or select another              **
2107 *****************************************************************************************************/
2108 int  RecipeExists(int keypad)
2109   {
2110     int            nextmode = RECIPE_EXISTS_MODE;
2111     char           valid_key = TRUE;              /* determines whether or not to beep for key input */
2112
2113     if ( mode_ctr == message_ctr || mode_ctr == 0L )
2114       {
2115         switch(message)
2116           {
2117             case 0:
2118               {
2119                 PosString(0, "   RECIPE EXISTS!   ");
2120                 PosString(20," Press ENTER PAD to ");
2121               }
2122               break;
2123
2124             case 1:
2125               {
2126                 PosString(0, "   PROGRAM OVER     ");
2127                 PosString(20,"EXISTING RECIPE or..");
2128               }
```

```
2129                break;
2130
2131              case 2:
2132                {
2133                  PosString(0, " Press PREV PAD to  ");
2134                  PosString(20," SELECT ANOTHER REC ");
2135                }
2136                break;
2137            }
2138
2139          message_ctr = mode_ctr + 600L;
2140
2141          if ( ++message > 2 )
2142            {
2143              message = 0;
2144            }
2145        }
2146
2147      switch(keypad)
2148        {
2149          case PREV:          nextmode = SELECT_RECIPE_MODE;          break;
2150          case ENTER:
2151            {
2152              if ( program_mode == PROG_ON_THE_FLY_MODE )
2153                {
2154                  ClearOut();                    /* clear recipe and header again */
2155                  TempMemToRecipe();             /* put temp recipe memory into recipe */
2156
2157                  header.oven_temp = start_temp;  /* store starting oven temperature */
2158                  header.auto_enable = TRUE;      /* default accu-time enabled */
2159                }
2160
2161              nextmode = SELECT_NAME_MODE;
2162            }
2163            break;
2164
2165          case RESET:         nextmode = STANDBY_MODE;                break;
2166
2167          default:            valid_key = FALSE;                      break;
2168        }
2169
2170      if ( valid_key )
2171        {
2172          Beep(150,tone);                        /* beep if valid key was pressed */
2173        }
2174
2175      else
2176        {
2177          mode_ctr++;
2178        }
2179
2180      if ( mode_ctr >= LONG_TIME_OUT )           /* 10 min */
2181        {
2182          nextmode = STANDBY_MODE;
2183        }
2184
2185      if ( nextmode != RECIPE_EXISTS_MODE )
2186        {
2187          Display(CLEAR);
2188          ResetCounters();
2189        }
2190
2191      return(nextmode);
2192
2193    }       /* end RecipeExists */
2194
2195
2196  /*****************************************************************************************************
2197  **      AccuTime MODE                          Prompt user to enable or disable Accu-Time              **
2198  *****************************************************************************************************/
2199  int  AccuTime(int keypad)
2200    {
2201      int           nextmode = ACCU_TIME_MODE;
2202      char          valid_key = TRUE;            /* determines whether or not to beep for key input */
2203
2204      if ( mode_ctr == message_ctr || mode_ctr == 0L )
```

```
2205        {
2206          if ( mode_ctr == 0
2207            {
2208              CursorType(NO_LIGHTING);
2209              PosString(0,"AutoSense <        >");
2210            }
2211
2212          UserPrompts(nextmode);                    /* display user prompt messages */
2213        }
2214
2215      switch(keypad)
2216        {
2217          case SLEW_LEFT:
2218          case SLEW_RIGHT:    header.auto_enable ^= 0x01;              break;
2219
2220          case PREV:
2221            {
2222              if ( program_mode == PROG_ON_THE_FLY_MODE )
2223                {
2224                  nextmode = SELECT_NAME_MODE;
2225                }
2226
2227              else
2228                {
2229                  nextmode = STAGE_ENTRY_MODE;
2230                }
2231            }
2232            break;
2233
2234          case ENTER:         nextmode = SAVE_RECIPE_MODE;             break;
2235          case RESET:         nextmode = STANDBY_MODE;                 break;
2236
2237          default:            valid_key = FALSE;                       break;
2238        }
2239
2240      if ( header.auto_enable )
2241        {
2242          PosString(11,"ENABLED ");
2243        }
2244
2245      else
2246        {
2247          PosString(11,"DISABLED");
2248        }
2249
2250      if ( valid_key )
2251        {
2252          Beep(150,tone);                           /* beep if valid key was pressed */
2253        }
2254
2255      else
2256        {
2257          mode_ctr++;
2258        }
2259
2260      if ( mode_ctr >= LONG_TIME_OUT )              /* 10 min */
2261        {
2262          nextmode = STANDBY_MODE;
2263        }
2264
2265      if ( nextmode != ACCU_TIME_MODE )
2266        {
2267          Display(CLEAR);
2268          ResetCounters();
2269        }
2270
2271      return(nextmode);
2272
2273    }       /* end AccuTime */
2274
2275
2276 /*****************************************************************************************************
2277 **      SaveRecipe MODE                    Prompt user to confirm saving of recipe                  **
2278 *****************************************************************************************************/
2279 int  SaveRecipe(int keypad)
2280   {
```

```
2281    int           nextmode = SAVE_RECIPE_MODE;
2282    int           num;
2283    char          valid_key = TRUE;              /* determines whether or not to beep for key input */
2284    static char   ee_error = FALSE;
2285
2286    if ( mode_ctr == message_ctr || mode_ctr == 0L )
2287      {
2288        switch(message)
2289          {
2290            case 0:
2291              {
2292                PosString(0, " Press SAVE PAD to  ");
2293                PosString(20," STORE RECIPE or..  ");
2294              }
2295              break;
2296
2297            case 1:
2298              {
2299                PosString(0, " Press PREV PAD to  ");
2300                PosString(20,"   REVIEW RECIPE    ");
2301              }
2302              break;
2303
2304          }
2305
2306        message_ctr = mode_ctr + 600L;
2307
2308        if ( ++message > 1 )
2309          {
2310            message = 0;
2311          }
2312      }
2313
2314    switch(keypad)
2315      {
2316        case PREV:          nextmode = ACCU_TIME_MODE;                break;
2317        case SAVE:
2318          {
2319            Beep(1000,tone);
2320            Display(CLEAR);
2321            PrintStr(" SAVING RECIPE: ");
2322
2323            Display(menu);
2324            num = recipe_num - ((menu - 65) * 10);    /* determine recipe */
2325            Display(num+48);
2326
2327            if ( program_mode == PROG_ON_THE_FLY_MODE )
2328              {
2329                nextmode = STANDBY_MODE;
2330              }
2331
2332            else
2333              {
2334                FilterRecipe();                   /* filter out stages < 5 sec in duration */
2335                nextmode = SELECT_RECIPE_MODE;
2336              }
2337
2338            ee_error = StoreRecipeInEE();         /***** save recipe ******/
2339
2340            if ( ee_error )                       /* exit on EEprom error */
2341              {
2342                service_code = MEMORY_ERROR_CODE;
2343              }
2344
2345            DelayMilliSecs(1500);
2346
2347            valid_key = FALSE;
2348          }
2349          break;
2350
2351        case RESET:         nextmode = STANDBY_MODE;                  break;
2352
2353        default:            valid_key = FALSE;                        break;
2354      }
2355
2356    if ( valid_key )
```

```
2357        {
2358          Beep(150,tone);                          /* beep if valid key was pressed */
2359        }
2360
2361      else
2362        {
2363          mode_ctr++;
2364        }
2365
2366      if ( mode_ctr >= LONG_TIME_OUT )             /* 10 min */
2367        {
2368          nextmode = STANDBY_MODE;
2369        }
2370
2371      if ( nextmode != SAVE_RECIPE_MODE )
2372        {
2373          Display(CLEAR);
2374          ResetCounters();
2375        }
2376
2377      return(nextmode);
2378
2379    }       /* end SaveRecipe */
2380
2381
2382 /*****************************************************************************************************
2383 **      DeleteRecipe MODE                    Prompt user to confirm deletion of recipe                  **
2384 *****************************************************************************************************/
2385 int  DeleteRecipe(int keypad)
2386   {
2387     int           nextmode = DELETE_RECIPE_MODE;
2388     int           num;
2389     char          valid_key = TRUE;              /* determines whether or not to beep for key input */
2390     static char   ee_error = FALSE;
2391
2392     if ( mode_ctr == message_ctr || mode_ctr == 0L )
2393       {
2394         switch(message)
2395           {
2396             case 0:
2397               {
2398                 PosString(0, "Press DELETE PAD to ");
2399                 PosString(20," DELETE RECIPE or.. ");
2400               }
2401               break;
2402
2403             case 1:
2404               {
2405                 PosString(0, " Press PREV PAD to  ");
2406                 PosString(20," SELECT ANOTHER REC ");
2407               }
2408               break;
2409
2410           }
2411
2412         message_ctr = mode_ctr + 600L;
2413
2414         if ( ++message > 1 )
2415           {
2416             message = 0;
2417           }
2418       }
2419
2420     switch(keypad)
2421       {
2422         case PREV:          nextmode = SELECT_RECIPE_MODE;              break;
2423         case DELETE:
2424           {
2425             Beep(1000,tone);
2426             Display(CLEAR);
2427             PrintStr("DELETING RECIPE: ");
2428
2429             Display(menu);
2430             num = recipe_num - ((menu - 65) * 10);       /* determine recipe */
2431             Display(num+48);
2432
```

```
2433            ClearOut();                                  /* clear recipe and header */
2434            header.name_num = -1;                        /* clear name to none */
2435
2436            ee_error = StoreRecipeInEE();
2437
2438            if ( ee_error )                              /* exit on EEprom error */
2439              {
2440                service_code = MEMORY_ERROR_CODE;
2441              }
2442
2443            DelayMilliSecs(1500);
2444
2445            nextmode = SELECT_RECIPE_MODE;
2446            valid_key = FALSE;
2447          }
2448          break;
2449
2450        case RESET:          nextmode = STANDBY_MODE;                    break;
2451
2452        default:             valid_key = FALSE;                          break;
2453      }
2454
2455    if ( valid_key )
2456      {
2457        Beep(150,tone);                                  /* beep if valid key was pressed */
2458      }
2459
2460    else
2461      {
2462        mode_ctr++;
2463      }
2464
2465    if ( mode_ctr >= LONG_TIME_OUT )                     /* 10 min */
2466      {
2467        nextmode = STANDBY_MODE;
2468      }
2469
2470    if ( nextmode != DELETE_RECIPE_MODE )
2471      {
2472        Display(CLEAR);
2473        ResetCounters();
2474      }
2475
2476    return(nextmode);
2477
2478  }       /* end DeleteRecipe */
2479
2480
```

```
1   /*****************************************************************************************************
2   **                                                                                                   **
3   **                                                                                                   **
4   **                                                                                                   **
5   **                                                                                                   **
6   **                                                                                                   **
7   **                    Copyright (C) 1996  Amana Refrigeration, Inc.  All Rights Reserved            **
8   *****************************************************************************************************
9   **                                                                                                   **
10  **                                                                                                   **
11  **                                                                                                   **
12  **                                                                                                   **
13  *****************************************************************************************************/
14
15  # include <oven.h>
16  # include <h338.h>
17
18  # include <recipes.h>
19  # include <display.h>
20  # include <eeprom.h>
21  # include <service.h>
22  # include <util.h>
23
24
25  /*****************************************************************************************************
26  **      ClearOut              clear out recipe stages and recipe header in RAM                      **
27  *****************************************************************************************************/
28  void ClearOut(void)
29    {
30     int          n;
31
32     for ( n = 0; n < 8; n++ )                        /* clearing out recipe stages */
33      {
34       recipe.stage[n].time = 0;
35       recipe.stage[n].center = 0;
36       recipe.stage[n].outer = 0;
37       recipe.stage[n].bottom = 0;
38      }
39
40     header.name_num = 0;                             /* clearing recipe header */
41     header.auto_enable = 0;
42     header.cook_time = 0;
43     header.oven_temp = 0;
44
45    }      /* ClearOut() */
46
47
48  /*****************************************************************************************************
49  **      TempMemToRecipe              moves optimized recipe in temp_recipe to recipe                **
50  *****************************************************************************************************/
51  void TempMemToRecipe(void)
52    {
53     int          entry = 0;
54
55     while( entry < 8 )
56      {
57        recipe.stage[entry].time = temp_recipe.stage[entry].time;
58        recipe.stage[entry].center = temp_recipe.stage[entry].center;
59        recipe.stage[entry].outer = temp_recipe.stage[entry].outer;
60        recipe.stage[entry].bottom = temp_recipe.stage[entry].bottom;
61
62        entry++;
63      }
64
65    }      /* end of TempMemToRecipe */
66
67
68  /*****************************************************************************************************
69  **      StoreRecipeInEE              Store recipe in EEprom memory calculate and store total cook   **
70  **                                   return any errors                                              **
71  *****************************************************************************************************/
72  int StoreRecipeInEE(void)
73    {
74      int       entry = 0;
75      int       header_address = HEADER_ADDR;
76      int       recipe_address = RECIPE_ADDR;
```

```
77      int       ee_error = 0;
78
79      header_address += (HEADER_SIZE * recipe_num);
80      recipe_address += (RECIPE_SIZE * recipe_num);
81
82      while ( entry < 8 && recipe.stage[entry].time != -1 )
83        {
84          entry++;
85        }
86
87      header.cook_time = recipe.stage[entry-1].time;
88
89      EE_ENABLE();                                  /* enable writing to eeprom */
90
91      ee_error += EEWriteBlock(header_address, (unsigned char *)&header, HEADER_SIZE);
92      ee_error += EEWriteBlock(recipe_address, (unsigned char *)&recipe, RECIPE_SIZE);
93
94      EE_DISABLE();                                 /* disable writes to eeprom */
95
96      return(ee_error);
97
98    }       /* end of StoreRecipeInEE */
99
100
101 /*****************************************************************************************************
102 **      GetRecipeToCook          Loads recipe from EEprom to RAM and then verifies the recipe          **
103 **                               re-called is not empty                                                **
104 *****************************************************************************************************/
105 int  GetRecipeToCook(int keypad)
106   {
107     int       ee_error = FALSE;
108     int       entry = 0;
109     int       time_adj = 0;
110     int       present_temp;
111
112     recipe_num = NumPadtoNum(keypad);
113
114     Display(CLEAR);                               /* display menu and recipe number */
115     DisMenuRecipe(menu, recipe_num);
116
117     recipe_num += (menu - 65) * 10;               /* determine recipe number based on menu & keypad */
118
119     if ( recipe_num < 0 || recipe_num >= 30 )
120       {
121         return(STANDBY_MODE);                     /* trapping for invalid number */
122       }
123
124     ee_error = LoadRecipe(recipe_num);            /* load recipe from EEprom */
125
126     if ( ee_error )                               /* if EEprom error exit */
127       {
128         ResetCounters();
129         service_code = MEMORY_ERROR_CODE;
130         return(SERVICE_CODE_MODE);
131       }
132
133     else                                          /* else coninue */
134       {
135         if ( header.name_num == -1 )              /* recipe doesn't exist, message and quit */
136           {
137             PrintStr(" NO RECIPE  ");
138             Beep(500,tone);
139             DelayMilliSecs(2500);
140             return(STANDBY_MODE);
141           }
142
143         else                                      /* recipe exists, cook */
144           {
145             GetLineFreq();                        /* determine line frequency 1st!!, mode service code */
146
147             if ( service_code == NO_ERROR_CODE )
148               {
149                 CheckModel();                     /* check model number, mod service code if neeeded */
150               }
151
152             if ( service_code == NO_ERROR_CODE )
```

```
153             {
154               CheckVoltage( );                    /* check line voltage mode service code if needed */
155             }
156
157           if ( service_code != NO_ERROR_CODE )
158             {
159               ResetCounters();
160               return(SERVICE_CODE_MODE);
161             }
162
163           else
164             {
165               CursorType(NO_LIGHTING);
166
167               prev_pwr_level[CENTER] = recipe.stage[0].center;
168               prev_pwr_level[OUTER] = recipe.stage[0].outer;
169               prev_pwr_level[BOTTOM] = recipe.stage[0].bottom;
170
171               *IER = 0x01;                        /* enable IRQ0 (zero-cross) */
172               synced_atod_sampling = TRUE;        /* for A to D sampling synced to line */
173
174               seconds = 0;                        /* reset line frequency based seconds counters */
175               seconds_old = 0;
176               ticks = 0;
177
178               if ( header.auto_enable )           /* determine if auto cook time is enabled */
179                 {
180                   present_temp = ReadTemp();
181
182                   time_adj = AutoCook(present_temp);
183                   Position(25);
184
185                   if ( time_adj < 0 )
186                     {
187                       PrintStr("a-");
188                     }
189
190                   else if ( time_adj > 0 )
191                     {
192                       PrintStr("a+");
193                     }
194
195                   else
196                     {
197                       PrintStr("a");
198                     }
199                 }
200
201               cook_time = header.cook_time + time_adj;
202
203               run_time = 0;                       /* reset run time and stage entry for recipe dev. */
204               stage_entry = 0;
205
206               Position(4);
207               PrintStr(recipe_name[header.name_num]);
208               Position(20);
209               PrintTime(cook_time, 60);
210               PosString(27,"   *COOKING* ");
211
212               ResetCounters();
213               mode_ctr = -2;
214
215               return(RECIPE_COOKING_MODE);        /* recipe cooking */
216             }
217         }
218     }
219
220 }       /* end GetRecipeToCook */
221
222
223 /*****************************************************************************************************
224 **      GetRecipeToProgram      Loads recipe from EEprom to RAM and then verifies the recipe        **
225 **                              re-called is not empty                                              **
226 *****************************************************************************************************/
227 int  GetRecipeToProgram(int keypad)
228   {
```

```
229     int        ee_error = FAL
230     int        entry = 0;
231
232     recipe_num = NumPadtoNum(keypad);
233
234     CursorType(NO_LIGHTING);                    /* make sure to turn off blinking cursor */
235     Display(recipe_num+48);
236
237     recipe_num += (menu - 65) * 10;             /* determine recipe number based on menu & keypad */
238
239     if ( recipe_num < 0 || recipe_num >= 30 )
240       {
241         return(STANDBY_MODE);                   /* trapping for invalid number */
242       }
243
244     ee_error = LoadRecipe(recipe_num);          /* load recipe from EEprom */
245
246     if ( ee_error )
247       {
248         service_code = MEMORY_ERROR_CODE;
249         return(SERVICE_CODE_MODE);
250       }
251
252     if ( header.name_num == -1 )                /* recipe doesn't exist */
253       {
254         if ( program_mode == DELETE_RECIPE_MODE )
255           {
256             PosString(20,"NO RECIPE TO DELETE ");
257             Beep(500,tone);
258             DelayMilliSecs(2500);
259             return(SELECT_RECIPE_MODE);
260           }
261
262         else
263           {
264             ClearOut();                         /* clear recipe and header */
265
266             if ( program_mode == PROG_ON_THE_FLY_MODE )
267               {
268                 TempMemToRecipe();              /* put temp recipe memory into recipe */
269                 header.oven_temp = start_temp;  /* store starting oven temp */
270                 header.auto_enable = TRUE;      /* default accu time enabled */
271               }
272
273             else
274               {
275                 Display(CLEAR);
276                 PosString(4,"ENTERING NEW");
277                 PosString(27,"RECIPE");
278                 Beep(500,tone);
279                 DelayMilliSecs(2500);
280
281                 stage_num = 1;                  /* stage 1 for initial programming */
282
283                 header.oven_temp = 90;          /* assume warm oven for manual programming */
284                 header.auto_enable = FALSE;     /* default accu time disabled */
285               }
286
287           return(SELECT_NAME_MODE);
288         }
289       }
290
291   else                                          /* recipe exists */
292     {
293       if ( program_mode == DELETE_RECIPE_MODE )
294         {
295           return(DELETE_RECIPE_MODE);
296         }
297
298       else if ( program_mode == PROG_ON_THE_FLY_MODE )
299         {
300           return(RECIPE_EXISTS_MODE);
301         }
302
303       else
304         {
```

```
305             Display(CLEAR);
306             PosString(0,"REVI    NG/MODIFYING");
307             PosString(22,"EXIS.ING RECIPE");
308             Beep(500,tone);
309             DelayMilliSecs(2500);
310
311             stage_num = 1;                          /* start with stage 1 for initial programming */
312
313             return(SELECT_NAME_MODE);
314           }
315       }
316
317   }       /* end GetRecipeToProgram */
318
319
320 /*****************************************************************************************************
321 **      LoadRecipe              Loads recipe from EEprom to RAM                                     **
322 *****************************************************************************************************/
323 int LoadRecipe(int recipe_num)
324   {
325     int       header_address = HEADER_ADDR;
326     int       recipe_address = RECIPE_ADDR;
327     int       ee_error = FALSE;
328
329     header_address += (HEADER_SIZE * recipe_num);
330     recipe_address += (RECIPE_SIZE * recipe_num);
331
332     ee_error += EEReadBlock(header_address, (unsigned char *)&header, HEADER_SIZE);
333     ee_error += EEReadBlock(recipe_address, (unsigned char *)&recipe, RECIPE_SIZE);
334
335     return(ee_error);
336
337   }       /* end of LoadRecipe */
338
339
340 /*****************************************************************************************************
341 **      OptimizeRecipe          optimize last timed run cooking program into 6 stages or less.      **
342 **                              optimize is acomplished by adding a filter number to the time of an **
343 **                              entry. The new time value is compared to each sucessive time entry  **
344 **                              until it is exceeded.  Once exceeded the previous entry settings are **
345 **                               substituted for the orginal entry added to.                        **
346 **                              if timed entry is not reduced to 6 staes or less the filter number is **
347 **                              increased and the optimized routine repeated.                       **
348 *****************************************************************************************************/
349 void OptimizeRecipe(void)
350   {
351     int   last_entry, eliminated, must_eliminate;
352     int   stage_num, filter, element, end_flag;
353     int   stage[8], n;
354
355     for ( n = 0; n < 8; n++ )
356       {
357         stage[n] = 0;
358       }
359
360     filter = 5;                                     /* set filter for 5 Seconds minimum stage duration */
361     last_entry = 0;
362     eliminated = 0;
363     end_flag = FALSE;
364     must_eliminate = 0;
365
366     while ( temp_recipe.stage[last_entry].time != -1 && last_entry < 26 )
367       {
368         last_entry++;                               /* determine last entry */
369       }
370
371     if ( last_entry > 8 )
372       {
373         must_eliminate = last_entry - 7;            /* determine the number of stages to be eliminated */
374
375         while ( eliminated < must_eliminate )
376           {
377             filter++;                               /* increase filter until # of stages are eliminated */
378
379
380
```

```
            eliminated = (     0)

            for ( n = 1; n <   _st_entry; n++ )
              {
                if ((temp_recipe.stage[n].time - filter) <= temp_recipe.stage[n-1].time )
                  {
                    eliminated++;
                  }
              }
          }          /* end of while */
      }              /* end of if */

    stage_num = 0;
    n = 1;

    if (must_eliminate != 0)                        /* determine stages to tranfer */
      {
        while ( stage_num < 7 && temp_recipe.stage[n-1].time != -1 )
          {
            if ( temp_recipe.stage[n-1].time < (temp_recipe.stage[n].time - filter)||
                          temp_recipe.stage[n].time == -1 )
              {
                stage[stage_num] = n-1;
                stage_num++;
                stage[stage_num] = n;
              }
            n++;
          }
      }

    else
      {
        for ( n = 0; n <= 7; n++)                   /* no stage to be eliminated */
          {
            stage[n] = n;
          }
      }

    for ( n = 0; n <= 7; n++)                       /* transfer stage info */
      {

        if (!n || end_flag)
          {
            temp_recipe.stage[n].time = 0;
          }

        else
          {
            temp_recipe.stage[n].time = temp_recipe.stage[stage[n]].time;
          }

        if ( temp_recipe.stage[stage[n]].time == -1 )
          {
            end_flag = TRUE;
          }

        if (!end_flag)
          {
            temp_recipe.stage[n].center = temp_recipe.stage[stage[n]].center;
            temp_recipe.stage[n].outer = temp_recipe.stage[stage[n]].outer;
            temp_recipe.stage[n].bottom = temp_recipe.stage[stage[n]].bottom;
          }

        else
          {
            temp_recipe.stage[n].center = 0;
            temp_recipe.stage[n].outer = 0;
            temp_recipe.stage[n].bottom = 0;
          }
      }          /* end of For Loop */

}      /*  end OptimizeRecipe  */


/*****************************************************************************************************************
**      FilterRecipe            similar to optimize routine, filters recipes manually entered in            **
```

stage

```
457  **                                  programming mode, applies filter to    ne times.  If entered stage        **
458  **                                  time is less than filter then that stage  is eliminated                  **
459  ***************************  ************************************************************************************/
460  void FilterRecipe(void)
461    {
462      int   last_entry;
463      int   stage_num, filter, element, end_flag;
464      int   stage[8], n;
465
466      for ( n = 0; n < 8; n++ )
467        {
468          stage[n] = 0;
469        }
470
471      filter = 4;                                    /* set filter for 5 Seconds minimum stage duration */
472      last_entry = 0;
473      end_flag = FALSE;
474
475      while ( recipe.stage[last_entry].time != -1 && last_entry < 8 )
476        {
477          last_entry++;                              /* determine last entry */
478        }
479
480      stage_num = 0;
481      n = 1;
482
483  /********************************** determine stages to tranfer ******************************************/
484
485      while ( stage_num < 7 && recipe.stage[n-1].time != -1 )
486        {
487          if ( recipe.stage[n-1].time < (recipe.stage[n].time - filter)||
488                                  recipe.stage[n].time == -1 )
489            {
490              stage[stage_num] = n-1;
491              stage_num++;
492              stage[stage_num] = n;
493            }
494          n++;
495        }
496
497      for ( n = 0; n <= 7; n++)                      /* transfer stage info */
498        {
499          if (!n || end_flag)
500            {
501              recipe.stage[n].time = 0;
502            }
503
504          else
505            {
506              recipe.stage[n].time = recipe.stage[stage[n]].time;
507            }
508
509          if ( recipe.stage[stage[n]].time == -1 )
510            {
511              end_flag = TRUE;
512            }
513
514          if (!end_flag)
515            {
516              recipe.stage[n].center = recipe.stage[stage[n]].center;
517              recipe.stage[n].outer = recipe.stage[stage[n]].outer;
518              recipe.stage[n].bottom = recipe.stage[stage[n]].bottom;
519            }
520
521          else
522            {
523              recipe.stage[n].center = 0;
524              recipe.stage[n].outer = 0;
525              recipe.stage[n].bottom = 0;
526            }
527        }          /* end of For Loop */
528
529  }      /*  end FilterRecipe  */
530
531
532  /*****************************************************************************************************************
```

```
533 **      AutoCook            calculates time adjustment based on current oven temperature and stored      **
534 **                          oven temp.  stores adjusted stage times in recipe memory                    **
535 ***********************************************************************************************************/
536 int AutoCook(int present_temp)
537   {
538     int          time_adjust, delta_temp, original_temp, num1, ratio;
539     long         original_time, num2;
540
541     original_temp = header.oven_temp;
542     original_time = header.cook_time;
543
544     if (present_temp == original_temp)
545       {
546         return(0);
547       }
548
549     if (present_temp >= 275)                    /* temperature doesn't matter after 275F  */
550       {
551         present_temp = 275;
552       }
553
554     if (original_temp >= 265)                   /* original temperature doesn't matter after 275F  */
555       {
556         original_temp = 275;
557       }
558
559     delta_temp = original_temp - present_temp;
560     num2 = ((long)delta_temp * (long)original_time)/AUTO_COOK_FACTOR;
561
562     time_adjust = (int)num2;
563
564     if (time_adjust == 0)
565       {
566         return(0);
567       }
568
569 /************************************ Adjust Times in recipe Stages  ************************************/
570
571     num2 = (((long)original_time + (long)time_adjust)*100L)/(long)original_time;
572     ratio = (int)num2;
573
574     if ( ratio > 200)                           /* max. ratio - 200% of original time */
575       {
576         ratio = 200;
577       }
578
579     else if ( ratio < 50 )                      /* min. ratio - 50% of original time */
580       {
581         ratio = 50;
582       }
583
584     num1 = 1;
585
586     while ( recipe.stage[num1].time != -1 )
587       {
588         num2 = ((long)recipe.stage[num1].time * (long)ratio)/100L;
589         recipe.stage[num1].time = (int)num2;
590
591         num1++;
592       }
593
594     num1--;
595
596     time_adjust = recipe.stage[num1].time - original_time;
597
598     return(time_adjust);
599
600   }   /* end of AutoCook() */
601
602
```

What is claimed is:

1. An oven using infrared radiant energy for cooking food comprising at least two infrared radiant energy elements each capable of operating at different intensity levels;

control means for setting the initial intensity level of each of said infrared radiant energy elements and changing the intensity level of said infrared radiant energy elements during cooking;

clock means for setting the overall cooking time and measuring the time at each change in intensity level of said infrared radiant energy elements;

memory for storing said initial intensity levels, as a first stage in a recipe, said overall cooking time, said time at each change in intensity level and said changed intensity level as another stage in a recipe; and optimizing device for determining that the number of stages exceed a predetermined limit and eliminating the number of stages above the limit based on the stored time of the stages.

2. An oven as set forth in claim 1 further comprising:

a screen for displaying the intensity level of each of said radiant cooking elements and said cooking time.

3. An oven as set forth in claim 2 wherein said memory comprises:

a temporary memory for storing said initial intensity levels, said cooking time, said time at each change in intensity level and said changed intensity level during the cooking cycle; and a permanent memory for storing said initial intensity levels, said cooking time, said time at each change in intensity level and said changed intensity level for subsequent retrieval and use in controlling the oven.

4. An oven as set forth in claim 3 wherein said control means comprises:

input control means capable of receiving input from the user of the oven; and intensity control means for setting the intensity level of said radiant elements.

5. An oven using radiant energy for cooking food as set forth in claim 1 wherein said clock means and said memory are part of a microprocessor.

6. An oven using infrared radiant energy for cooking food comprising:

at least two infrared radiant energy elements each capable of operating at different intensity levels;

input control means for receiving instructions for initially setting the intensity level of each of said radiant energy elements, changing the intensity level of said radiant energy elements during the cooking cycle and setting an overall cook time;

a microprocessor for storing said initial setting of said intensity levels of each of said radiant energy elements as a first stage in a recipe, said overall cook time, said changes in intensity level of said radiant energy element during the cooking cycle and the time at each change in intensity level as another stage in the recipe;

a screen for displaying said initial intensity levels of said radiant elements, said cook time and the changes of said intensity levels during the cook cycle; and an optimizing device for determining that the number of stages exceed a predetermined limit and eliminating the number of stages above the limit based on the stored time of the stages.

7. A method of developing a recipe capable of controlling an oven using radiant energy for cooking food, said oven having at least two radiant energy cooking elements each capable of operating at different intensity levels comprising the steps of:

(a) setting the initial intensity level of each radiant energy cooking element;

(b) setting the overall cook time;

(c) storing the initial intensity levels of each radiant energy element and a time equal to zero in temporary memory as a first stage in the recipe;

(d) storing the overall cook time in temporary memory and initiating the cooking cycle;

(e) changing the intensity level of one of said radiant energy elements during the cooking cycle;

(f) determining the time in the cooking cycle at which the change in intensity level occurs;

(g) storing the changed intensity level and the time the change occurred in temporary memory as another stage in the recipe;

(h) repeating steps e through g until the overall cook time elapses or power to the radiant energy elements is shut off;

(i) optimizing the recipe by deleting the number of stages that exceed a predetermined limit and have the shortest time; and (j) storing each stage of the recipe in permanent memory.

8. A method of developing a recipe as set forth in claim 7 further comprising:

(i) adding time to the overall cook time before step i;

(j) repeat step h until expanded overall cook time elapses or power to the radiant element is shut off.

9. A method of developing a recipe as set forth in claim 7 further comprising:

optimizing the number of stages before step i by deleting stages which operate for a period of time below a predetermined value.

10. A method of developing a recipe as set forth in claim 9 further comprising:

(k) retrieving the stored optimized recipe from memory; and (l) operating the oven pursuant to the retrieval recipe.

11. A method of developing a recipe as set forth in claim 7 further comprising:

(m) retrieving the stored recipe from memory; and (n) operating the oven pursuant to the retrieval recipe.

12. A method of optimizing a developed recipe having a plurality of stages and used for controlling an oven having radiant elements to cook food comprising:

determining the number of stages in the developed recipe;

determining the number of stages that must be deleted so that the total number of stages does not exceed a predetermined limit;

determining the minimum duration of a stage so that an appropriate number of stages can be deleted;

deleting from memory each stage having a time duration below the minimum; and storing the remaining stages in permanent memory.

* * * * *